US006065778A

United States Patent [19]

Dovel et al.

[11] Patent Number: 6,065,778

[45] **Date of Patent: *May 23, 2000**

[54] MULTIPLE LEAFLET LITERATURE ASSEMBLY AND ARTICLE CONVERTIBLE TO AN ENVELOPE

[75] Inventors: Keith R. Dovel, Kernersville; Carl W. Treleaven, Greensboro, both of N.C.

[73] Assignees: Pharmagraphics (Midwest), L.L.C., Itasca, Ill.; Pharmagraphics (Southeast), L.L.C., Greensboro, N.C.

[ * ] Notice: This patent is subject to a terminal disclaimer.

[21] Appl. No.: 09/131,586

[22] Filed: Aug. 10, 1998

Related U.S. Application Data

[63] Continuation-in-part of application No. 08/470,223, Jun. 6, 1995, Pat. No. 5,791,689.

[51] Int. Cl.[7] ..... B42D 19/00

[52] U.S. Cl. ..... 281/5; 283/61; 283/62

[58] Field of Search ..... 281/2, 5, 6; 283/61, 283/62, 63.1, 51, 52

[56] References Cited

U.S. PATENT DOCUMENTS

| | | | |
|---|---|---|---|
| 645,820 | 3/1900 | Lohrman . | |
| 755,159 | 3/1904 | Morton . | |
| 1,040,004 | 10/1912 | Patton . | |
| 2,157,740 | 5/1939 | Quinlan | 206/29 |
| 3,306,632 | 2/1967 | Stahmer | 282/25 |
| 3,593,443 | 7/1971 | Demetrius, Jr. et al. | 40/2 R |
| 3,718,277 | 2/1973 | Volkert | 229/73 |
| 3,941,309 | 3/1976 | Gendron | 229/73 |
| 4,010,299 | 3/1977 | Hershey, Jr. et al. | 428/44 |
| 4,010,964 | 3/1977 | Schechter | 283/56 |
| 4,441,739 | 4/1984 | Cluff et al. | 281/16 |
| 4,516,793 | 5/1985 | Kiyokane | 283/103 |
| 4,566,720 | 1/1986 | Goldman et al. | 281/15 R |
| 4,583,763 | 4/1986 | Shacklett, Jr. | 281/5 |
| 4,583,765 | 4/1986 | Messinger | 282/9 R |
| 4,632,427 | 12/1986 | Angus | 282/11.5 R |
| 4,637,633 | 1/1987 | Instance | 283/81 |
| 4,773,584 | 9/1988 | Instance | 229/74 |
| 4,850,612 | 7/1989 | Instance | 281/5 |
| 4,850,613 | 7/1989 | Instance | 281/5 |
| 5,141,252 | 8/1992 | Michlin | 281/15.1 |
| 5,253,898 | 10/1993 | Mangione | 283/62 |
| 5,286,062 | 2/1994 | Greenwood et al. | 283/106 |
| 5,857,705 | 1/1999 | Dahlquist | 283/61 X |
| 5,909,899 | 6/1999 | Vijuk et al. | 283/61 X |

FOREIGN PATENT DOCUMENTS

| | | |
|---|---|---|
| 1475304 | 6/1977 | United Kingdom . |
| 2 115 744 | 9/1983 | United Kingdom . |
| 2 115 775 | 9/1983 | United Kingdom . |

*Primary Examiner*—Willmon Fridie, Jr.
*Attorney, Agent, or Firm*—Myers Bigel Sibley & Sajovec

[57] ABSTRACT

A literature assembly providing for verification of a plurality of leaflets of first and second types by inspecting only one leaflet of each type. The literature assembly includes a first leaflet secured to an assembly of leaflets, the assembly of leaflets including a plurality of integral and detachable leaflets. The first leaflet includes a first identifier and the assembly of leaflets includes a second identifier. Preferably, the first and second identifiers are electronically readable identifiers corresponding to information imprinted on each of the first and second leaflets, respectively. Each of the leaflets of the assembly of leaflets may be verified by inspecting a single panel of the assembly of leaflets.

The assembly of leaflets includes a single sheet folded about a first fold line and about a second fold line transverse to the first fold line. The sheet is divided by the first and second fold lines into at least four panels. The second fold lines define respective second leaflets. A tear line is preferably provided at each of the second fold lines so that respective leaflets may be detached from one another.

The assembly of leaflets may be used in a literature assembly or alone. The leaflets of the assembly of leaflets may have substantially different, related indicia imprinted thereon. At least one of the leaflets may be formable into an envelope. The envelope so formed may be sized and configured to receive another of the leaflets. The envelope may be sealed by means of an adhesive strip or a self-adhesive wafer.

54 Claims, 14 Drawing Sheets

MULTIPLE LEAFLET LITERATURE ASSEMBLY AND ARTICLE CONVERTIBLE TO AN ENVELOPE

This is a continuation-in-part application of pending U.S. patent application Ser. No. 08/470,223, filed Jun. 6, 1995 now U.S. Pat. No. 5,791,689.

FIELD OF THE INVENTION

The present invention is directed to literature leaflets and, more particularly, to an assembly of leaflets including a plurality of individual leaflets, a literature assembly including such an assembly of leaflets, and a leaflet having at least a portion thereof formable into an envelope.

BACKGROUND OF THE INVENTION

For certain pharmaceutical products (e.g., birth control pills), the government has required that in addition to the mandatory disclosure information provided to the pharmacist and/or physician, there must also be a disclosure circular provided for the patient. The two circulars are quite different in terms of information. This requirement has posed a significant problem for the pharmaceutical industry in that pharmaceutical suppliers are required to insure that every lot of product is shipped with both types of disclosure circulars and that at least the required member be present. For products that are packed in a shipping case, the supplier must make certain that there is at least one patient package circular for every individual product container and at least one pharmacist/physician circular in the shipping carton.

Historically, pharmaceutical companies have had extra personnel on the packaging lines to place all of these different pieces of literature, often by hand, into shipping cases. This is a labor-intensive operation, and errors are often made. A critical error arises where the leaflets provided do not correspond to the pharmaceutical being shipped.

In a prior attempt to address this problem, applicant developed a machine designed to take two or more standard leaflets and glue them together in a stack, one leaflet on top of the other. FIG. 8 shows an example of an assemblage of leaflets according to this design. Patient leaflets 92, for example, are releasably adhered to the surface of one another and then to a physician leaflet 90 by adhesive 94. In the case of a pharmaceutical product requiring one pharmacist/physician leaflet and multiple patient leaflets, the pharmaceutical product may be supplied with a multiple leaflet assembly as shown in FIG. 8. This design provides several important benefits. The design provides for convenient packaging of the leaflets, exact quantities of each type of leaflet, and the potential for automatic application to a package.

While the above-disclosed design has some very important benefits, new Federal regulations due to take effect in the near future create a major drawback for that design. These regulations mandate that all pharmaceutical cut literature assemblies, including leaflets in the form of outserts and inserts, must be verified electronically prior to application to a pharmaceutical product. The most cost-effective means of electronic verification is a bar code. The problem with the above-disclosed design is that if there are more than two leaflets separately formed and joined together in a stack, it is not feasible to verify each component electronically by a bar code (e.g., for a three leaflet label, one could electronically verify the two leaflets on the ends of the assemblage, but could not verify the leaflet sandwiched between the other two). Thus, for accurate and convenient electronic verification, the design disclosed above is only appropriate for literature assemblies having two leaflets.

Thus, there exists the need for a multiple leaflet assembly which provides for accurate and convenient verification of a plurality of extended text leaflets forming a single literature assembly.

It is often necessary to provide information for the patient in more than one language. However, it is necessary that the disclosures in each language be verified. One way of achieving this is to print the disclosures in each language on a single sheet which is folded into a multi-panel leaflet. The patient must locate the appropriate language, disregarding the other language(s). This arrangement presents an unduly cumbersome leaflet because very often the leaflet will have a number of panels which serve no further purpose, being in a language unreadable by the patient, but which nonetheless must be refolded.

In some instances, the patient must be provided with a series of different but related disclosures such as daily instructions for administering a pharmaceutical product. Again, it is necessary that these related disclosures be verified. This may be accomplished by printing each of the series of instructions on a single sheet which is thereafter folded into a multi-panel leaflet. This approach has a significant drawback in that the patient must repeatedly unfold and refold the leaflet, including panels bearing instructions which have already been referenced and are no longer needed. The continued presence of such instructions increases the risk that the patient may be confused and follow the older, inappropriate instructions.

In some instances, a pharmaceutical manufacturer or distributor may desire to collect consumer feedback or consumer information, e.g., demographic information. One method for collecting such information is to provide the patient leaflet with a detachable return card. The patient fills out the form on one side of the card and deposits the card for return to an address pre-printed on the other side of the card. A rebate or the like may be offered as an incentive to return the card. One problem with this method is that many consumers are reluctant to provide confidential and even non-confidential information on the card because it may be exposed during mailing. Also, the return envelope must comply with certain minimum dimensions required by the United States Postal Service.

It is known to provide a printed sheet, for example, a billing statement, which may be converted, for example, by a billed customer, into a return envelope. Typically, the return envelope is sealed by wetting a strip of dry adhesive provided on the sheet and mating selected panels of the sheet. Some users find the wetting step objectionable. Further, there is a risk that the user will not properly activate the adhesive or mate the panels, so that the envelope is not suitably formed and sealed for the rigors of postal handling.

SUMMARY OF THE INVENTION

An object of the present invention is to provide a literature assembly for placement in or on a package.

A further object of the present invention is to provide a multiple leaflet literature assembly which provides for accurate and convenient verification of a plurality of leaflets forming a single literature assembly.

An object of the present invention is to provide a literature assembly as described above which may be cost-effectively manufactured.

Moreover, an object of the present invention is to provide a literature assembly as described above which lends itself to manufacture by automatic production apparatus.

An object of the present invention is to provide a literature assembly which minimizes or eliminates errors associated with the matching of dissimilar but related extended text literature leaflets.

An object of the present invention is to provide a unitary assembly of leaflets having leaflets forming a part thereof imprinted with substantially different, related indicia such as physician/pharmacist information and patient information.

Yet another object of the present invention is to provide a unitary assembly of leaflets having a leaflet forming a part of the assembly of leaflets which is formable into an envelope for receiving another leaflet of the assembly.

Another object of the present invention is to provide a folded leaflet which may be converted to form an envelope having a greater overall area than the original folded leaflet.

The present invention is directed to a literature assembly providing for verification of all of one or more leaflets of a first type and each of a plurality of leaflets of a second type by inspecting only one leaflet of each type. Each of the second leaflets are provided in an assembly of leaflets formed from an integral sheet such that each of the second leaflets includes multiple panels and all of the second leaflets may be verified by inspecting only one panel of only one second leaflet.

The literature assembly includes a first leaflet which may be, for example, a physician/pharmacist leaflet, having a first identifier and an assembly of leaflets secured to the first leaflet and having a second identifier. The assembly of leaflets is formed from a single sheet, wherein the sheet is folded about a first series of one or more fold lines and about a second series of one or more fold lines transverse to the first series to form a plurality of second leaflets which may be, for example, patient leaflets. The sheet is divided by the aforementioned fold lines into at least four panels. The second fold line defines at least a pair of second leaflets, one of the second leaflets disposed on either side of the second fold line. Additionally, a tear line is provided at the second fold line. Respective second leaflets may be detached from one another by tearing along the tear line. Preferably, the first leaflet is releasably secured to the assembly of leaflets. Furthermore, the first and second identifiers preferably include electronically readable identifiers (bar codes or two-dimensional codes) corresponding to information imprinted on each of the first leaflet and the second leaflet, respectively.

Literature assemblies according to the present invention may be formed by the following method. The assembly of leaflets is formed by folding a single sheet about a first fold line, then folding the sheet about a second line transverse to the first fold line, thereby forming a pair of leaflets defined on either side of the second fold line. A tear line is formed at the second fold line. A first identifier is imprinted on the first leaflet. A second identifier is printed on the assembly of leaflets. The assembly of leaflets is releasably secured to the first leaflet.

Literature assemblies according to the present invention may be used as follows. The first and second identifiers are electronically read in order to verify the first and second leaflets. The literature assembly is placed in or on a package. Thereafter, the first leaflet is removed from the assembly of leaflets and/or one or more of the second leaflets are detached from one another by tearing along the aforementioned tear line.

The present invention is further directed to an assembly of leaflets as described above which may be used in a literature assembly as described or alone. The assembly of leaflets includes a single sheet folded about a first fold line and about a second fold line transverse to the first fold line. The sheet is thereby divided into at least four panels. The second fold line defines a pair of leaflets with one of the leaflets disposed on either side of the second fold line. A tear line is provided at the second fold line whereby respective leaflets may be detached from one another. Each of the leaflets has substantially different, related indicia imprinted thereon.

In the assembly of leaflets as described above, one of the pair of leaflets may comprise a greater number of panels than the other leaflet. In certain preferred embodiments, one of the pair of leaflets has indicia imprinted thereon representing information directed to a physician or pharmacist and the other leaflet has indicia imprinted thereon directed to a patient. One of the pair of leaflets may have indicia imprinted thereon representing information directed to a patient and in a first language with the other leaflet having indicia imprinted thereon representing information directed to the patient and in a second, different language.

The present invention is further directed to an assembly of leaflets as described above, which may or may not have substantially different, related indicia as described, wherein at least one of the leaflets is formable into an envelope sized and configured to receive another of the leaflets. The assembly of leaflets may include a wafer having a coating of adhesive on a rear surface thereof. The wafer is releasably adhered to the sheet by the adhesive such that, upon removal of the wafer from the sheet, the adhesive remains on the rear surface and is operable to readhere the wafer to the sheet.

The present invention is further directed to a unitary convertible, folded leaflet which may itself be used both for receiving information from an end user and as an envelope for returning the information to a manufacturer or the like. The convertible leaflet includes a single sheet folded about a first fold line and a second fold line transverse to the first fold line, thereby dividing the sheet into at least four panels. Selectively activatable adhesive is positioned on at least some of the panels such that, when the leaflet is unfolded about the second fold line, the facing panels may be secured to one another to form an envelope having an overall area greater than that of the original folded leaflet. One or more detachable panels are provided and joined to the convertible leaflet along a tear line. Furthermore, the leaflet may be configured to provide two or more separate envelope portions.

The present invention is also directed to an article convertible by a user into an envelope which includes a sheet foldable to form an envelope. A wafer having a coating of adhesive on a rear surface thereof is releasably adhered to the sheet by the adhesive such that, upon removal of the wafer from the sheet, the adhesive remains on the rear surface and is operable to readhere the wafer to the sheet. Indicia is disposed on at least one of the sheet and the wafer. The indicia directs the user to use the wafer to secure the envelope in a closed position. Preferably, a varnish coating is directly disposed on the sheet and between the sheet and the adhesive. The wafer is releasably adhered to the varnish coating.

The present invention is further directed to a method of converting an informational sheet into a return envelope. The method includes providing an article having a sheet foldable to form an envelope and a wafer. The wafer has a coating of adhesive on a rear surface thereof. The wafer is releasably adhered to the sheet by the adhesive such that, upon removal of the wafer from the sheet, the adhesive remains on the rear surface and is operable to readhere the wafer to the sheet. According to the method, the wafer is removed from the sheet. The sheet is folded to form the envelope. The wafer is reapplied to the folded sheet such that the wafer is adhered thereto and thereby maintains the envelope in a closed position.

DETAILED DESCRIPTION OF THE INVENTION

Figure 1:
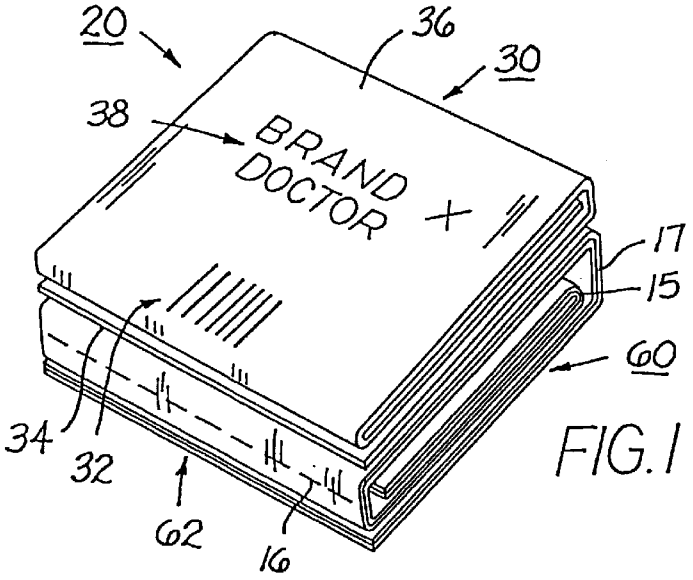
FIG. 1 is a perspective view of a multiple leaflet literature assembly according to the present invention including an assembly of leaflets.

The term "leaflet" as used herein means any type of extended text literature assembly, whether intended as an outsert, i.e., for placing on the exterior of a package, or as an insert, i.e., for placing within a package. Moreover, except as may be critical to the formation of the literature assembly according to the present invention, a leaflet may be of any suitable formation, e.g., spirally or fan-folded, and is in no way intended to be restricted to the exact embodiment described hereafter which is merely illustrative of a preferred embodiment.

With reference to FIGS. 1–7, a literature assembly according to the present invention and indicated generally by the numeral 20 is shown therein. Literature assembly 20 includes first leaflet or physician/pharmacist leaflet 30 and assembly of leaflets 60. Bottom panel 34 of first leaflet 30 is releasably secured to panel 7 of assembly of leaflets 60 by adhesive spots 50. Adhesive 50 is preferably Fuller Adhesive Product No. HL2198. As an alternative or in addition to adhesive 50, first leaflet 30 may be coupled with assembly of leaflets 60 by a rubber band (not shown) or a paper band (not shown).

Figure 2:
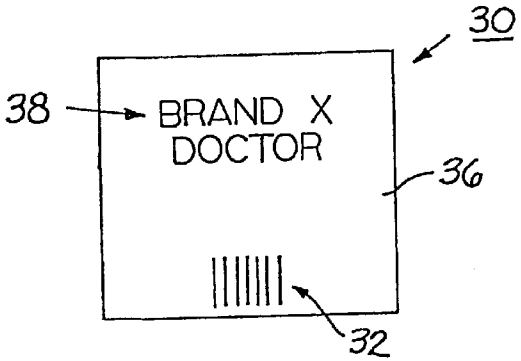
FIG. 2 is a top plan view of the literature assembly of FIG. 1.

As best seen in FIG. 2, top or title panel 36 of physician/pharmacist leaflet 30 has imprinted thereon commonly readable indicia 38 and electronically readable identifier 32, preferably a bar code. Indicia 38 serves to inform the user that first leaflet 30 includes a first type of information, such as, for example, information for the physician or pharmacist distributing a pharmaceutical product. Identifier 32 is coded to correspond to a record in an electronic database and corresponds to the information indicated by indicia 38.

Figure 3:
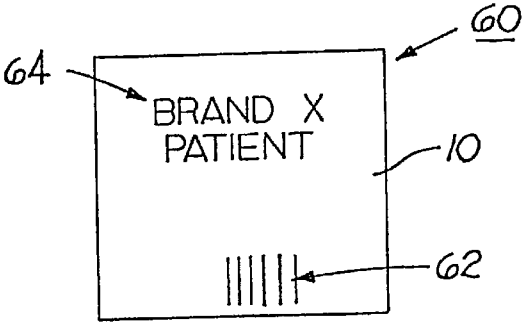
FIG. 3 is a bottom plan view of the literature assembly of FIG. 1.

As best seen in FIG. 3, bottom or title panel 10 of assembly of leaflets 60 has imprinted thereon indicia 64 and electronically readable identifier 62, preferably a bar code. Indicia 64 serves to inform the user that assembly of leaflets 60 includes a second type of information, such as, for example, information for the patient receiving the same particular pharmaceutical product as included in physician/pharmacist leaflet 30. Identifier 62 is coded to correspond to a record in an electronic database and corresponds to the information indicated by indicia 64.

Figure 4:
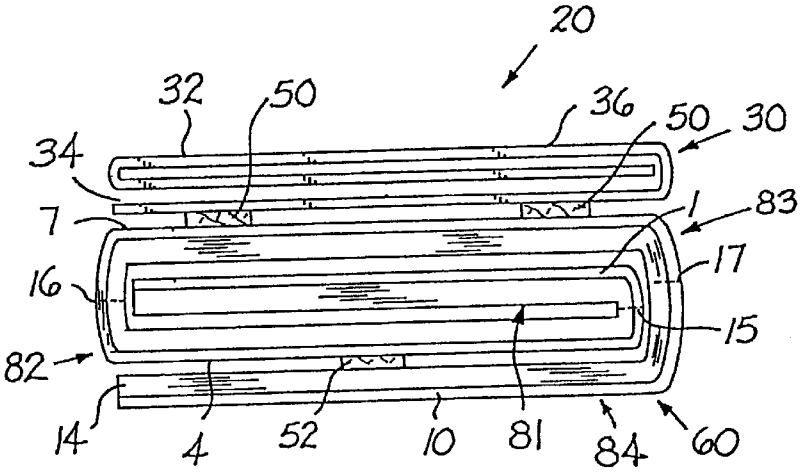
FIG. 4 is a side elevational view of the literature assembly of FIG. 1.

Turning now to FIG. 4 in more detail, physician/pharmacist leaflet 30 is shown as a common, spirally-folded "ribbon," extended text leaflet. It will be appreciated that physician/pharmacist leaflet 30 may be any type of single or multiple panel leaflet including an assembly of leaflets identical or similar to assembly of leaflets 60.

Assembly of leaflets 60 is similarly spirally folded. It will be appreciated that assembly of leaflets 60 may likewise be fan-folded or otherwise folded as best suits the needs of the user and/or manufacturing process and apparatus.

Referring now to assembly of leaflets 60 in greater detail, it will be seen that assembly of leaflets 60, as shown in FIG. 4, is divided into four second leaflets or patient leaflets 81, 82, 83, 84. Patient leaflets 81 and 82 are separated by tear line 15; patient leaflets 82 and 83 are separated by tear line 16; patient leaflets 83 and 84 are separated by tear line 17.

Figure 5:
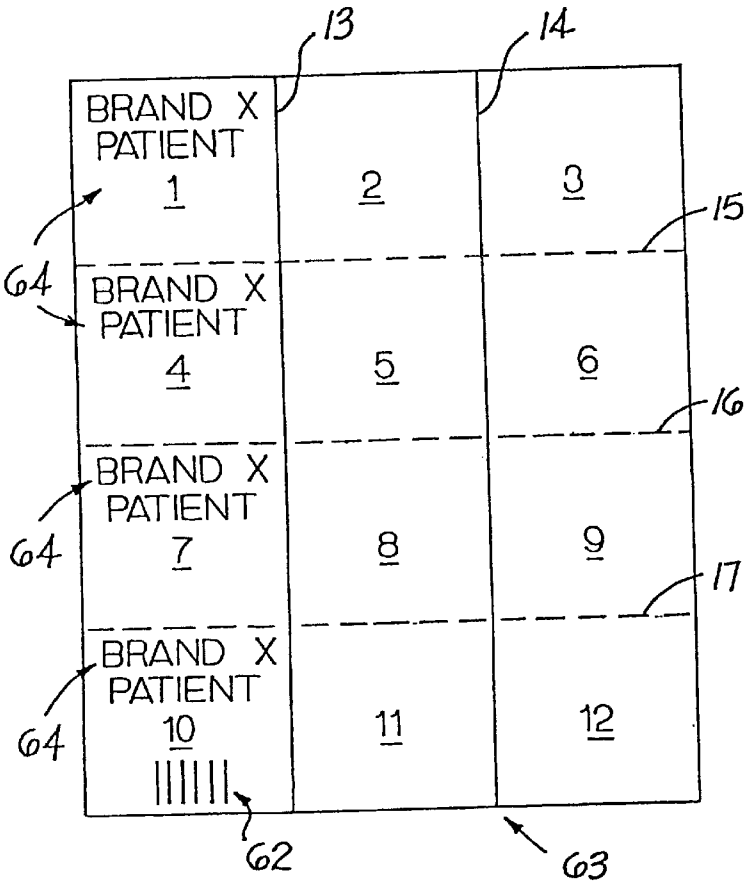
FIG. 5 is a top plan view of the sheet forming the assembly of leaflets of the present invention, the sheet being unfolded.
Figure 8:
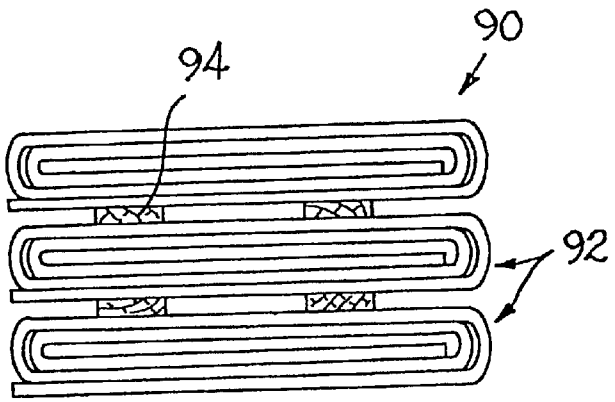
PRIOR ART FIG. 8
FIG. 8 is a multiple leaflet literature assembly according to applicant's prior art design.

The actual construction of assembly of leaflets 60 and patient leaflets 81, 82, 83, 84 is best understood by reference to FIGS. 4–7. As best seen in FIG. 5, sheet 63 includes panels 1–12. Panels 1–12 are defined by longitudinal fold lines 13, 14 and transverse fold/tear lines 15, 16, 17. Patient leaflet 81 is formed from panels 1–9; patient leaflet 82 is formed from panels 4–6; patient leaflet 83 is formed from panels 7–9; patient leaflet 84 is formed from panels 10–12. Each of panels 1, 4, 7, and serve as title panels for the individual patient leaflets and have imprinted thereon indicia 64. Panel 10 also serves as the title panel for assembly of leaflets 60 and has identifier 62 imprinted thereon.

Figure 6:
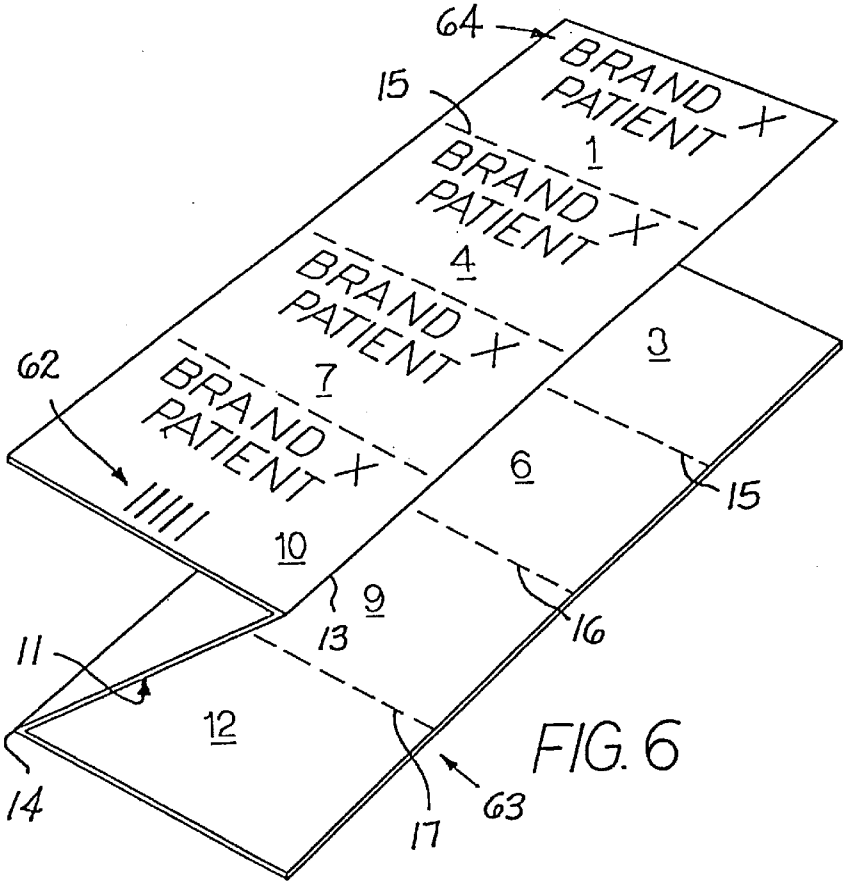
FIG. 6 is a perspective view of the sheet forming the assembly of leaflets according to the present invention, the sheet being folded about the longitudinal fold lines.

Assembly of leaflets 60 is constructed as follows. As shown in FIG. 6, panels 1, 4, 7, and 10 are folded about longitudinal fold line 13 back onto panels 2, 5, 8, and 10, respectively, and panels 2, 5, 8, and 11 are folded about longitudinal fold line 14 forward onto panels 3, 6, 9, and 12, respectively. Next, panels 1, 2, and 3 are folded about transverse fold line 15 downwardly and under panels 4, 5, and 6. Panels 4, 5, and 6 are folded downwardly and under about transverse fold line 16, placing panels 1–6 beneath panels 7, 8, and 9. Finally, panels 7, 8, and 9 are folded about transverse fold line 17, placing panels 1–9 beneath panels 10, 11, and 12, thereby forming assembly of leaflets 60 as shown in FIG. 4. Preferably, transverse fold lines 15, 16, 17 are formed at a right angle to longitudinal fold lines 13, 14, as shown in the figures. Adhesive spot 52 is placed between panels 12 and 4 to hold assembly of leaflets 60 in the folded configuration.

Figure 7:
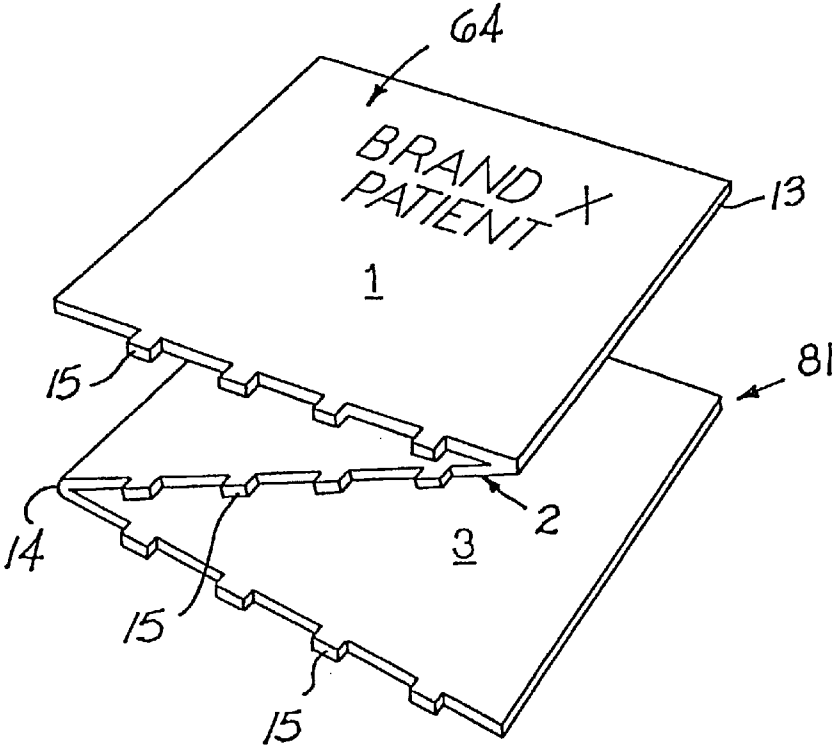
FIG. 7 is a perspective view of a second leaflet removed from the assembly of leaflets according to the present invention, the sheet being folded about the transverse fold lines.

Each of patient leaflets 81, 82, 83, and 84 may be removed from assembly of leaflets 60 by tearing along respective tear lines 15, 16, and 17. For example, as shown in FIG. 7, patient leaflet 81 which consists of panels 1, 2, and 3 may be detached from assembly of leaflets 60 by tearing along tear line 15. The assembly of leaflets may then be refolded. Tear lines 15, 16, 17 are preferably perforations.

It will be appreciated that assembly of leaflets 60 may be formed from any number of longitudinal and transverse fold lines, there being at least one of each. Thus, there could be as few as two patient leaflets.

Assembly of leaflets 60 provides several significant benefits. Multiple individual leaflets may be formed from a single printing step on the sheet. Multiple leaflet literature assemblies may be provided with little or no use of adhesive to hold the leaflets together.

Literature assembly 20 has as a primary advantage, in addition to the benefits of assembly of leaflets 60, convenient and reliable verification of all of the physician/pharmacist and patient leaflets by electronic reading means. Because patient leaflets 81, 82, 83, 84 are printed on one sheet 63, each of patient leaflets 81, 82, 83, 84 may be guaranteed to be of the same type. Thus, identifier 62 corresponds to all of patient leaflets 81, 82, 83, and 84. Identifier 62 may be read by a reader passing below literature assembly 20, and identifier 32 of physician/pharmacist leaflet 30 may be read by a reader passing above literature assembly 20. In this way, all of the physician/pharmacist and patient leaflets are verified in a single pass through a simple, two-sensor electronic reader apparatus and only panels 36 and 10 need be exposed to the reader.

The information printed on each of patient leaflets 81, 82, 83, 84 may be the same for distribution to different patients or may be different but related information for distribution to one patient. For example, each leaflet 81, 82, 83, 84 may have instructions printed thereon for periodic referral (e.g., daily instructions). The patient may tear off leaflet 81, read and follow the instructions printed on leaflet 81, and thereafter he or she may discard leaflet 81. Similarly, as each of the remaining leaflets are used, they may be discarded. As a result, the leaflets no longer inconvenience handling and are not present to confuse the patient after they have been used.

Figure 9:
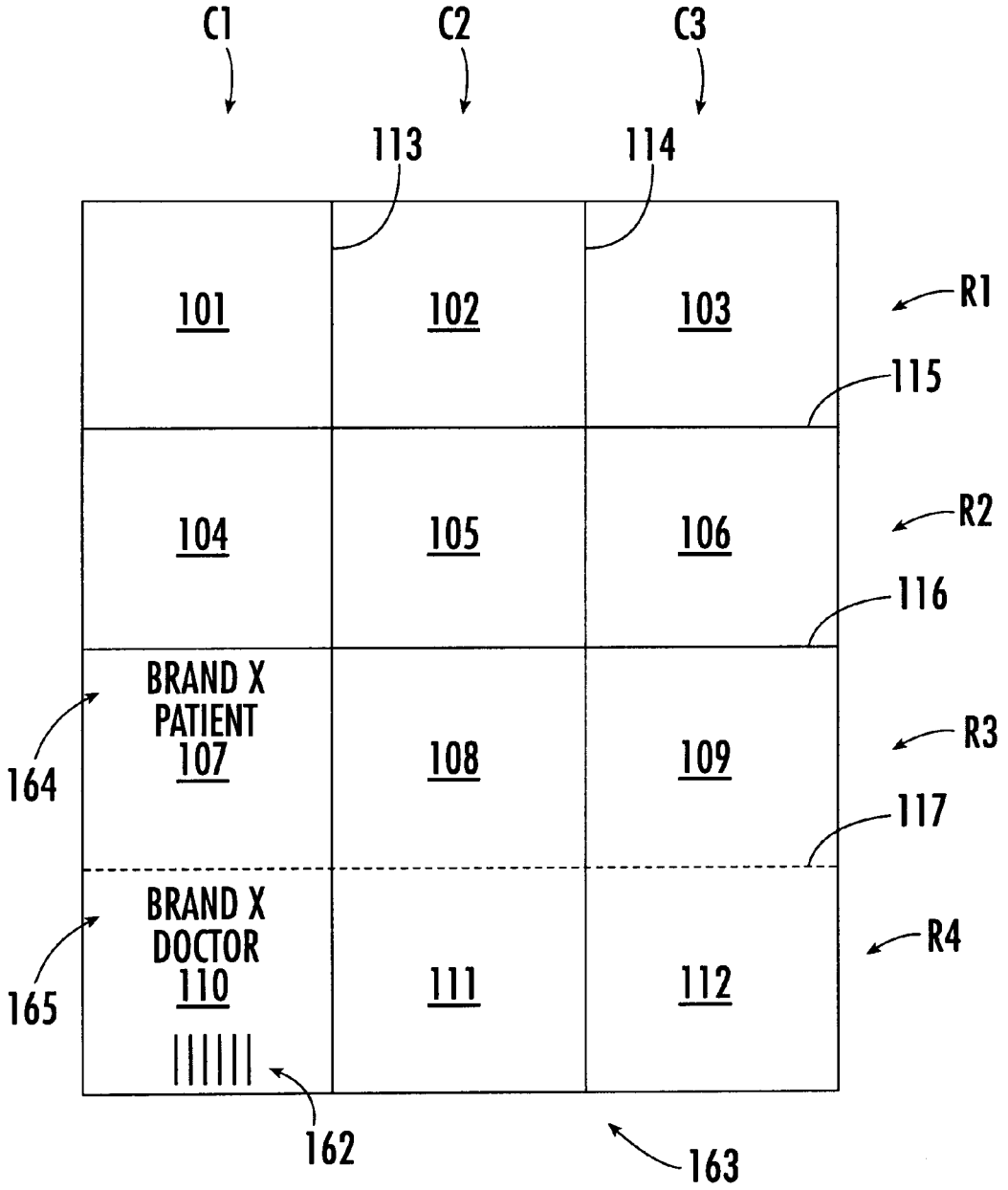
FIG. 9 is a top plan view of a sheet for forming an assembly of leaflets according to a second embodiment of the present invention.

In the example described above, leaflets 81, 82, 83, and 84 of assembly of leaflets 60 are each printed with information intended for the patients. In an assembly of leaflets according to a further embodiment of the present invention, a portion of the assembly of leaflets is printed with information intended for the physician or pharmacist and a portion of the assembly is printed with information intended for the patient or patients. With reference to FIG. 9, the assembly of leaflets is formed form a sheet 163 having panels 101 to 112 corresponding to panels 1 to 12, respectively, of sheet 63. Panels 101 to 112 are folded about lines 113, 114, 115, 116, and 117 (which correspond to lines 13, 14, 15, 16, and 17, respectively) in the same manner as described above with respect to assembly of leaflets 60 to form an assembly of leaflets of the same construction except as follows.

Whereas lines 15 and 16 of assembly of leaflets 60 are tear lines, lines 115 and 116 are merely fold lines. Thus, the assembly of leaflets formed from sheet 163 is separable along tear line 117 into two unitary, multi-panel leaflets. The first such leaflet consists of panels 110, 111, and 112 which are printed with suitable indicia for reference by the pharmacist or physician, including indicia 165 on panel 110 designating the leaflet as the pharmacist or physician leaflet. The physician/pharmacist information may include, for example, pharmacological data, contra indications, drug interactions and dispensing information. The second such leaflet consists of panels 101 to 109 which are printed with suitable indicia for reference by the patient, including indicia 164 designating the leaflet as the patient leaflet. The patient information may include, for example, warnings, usage, and dangers.

Notably, the assembly of leaflets formed from sheet 163 will be unitary from the beginning of its manufacture to the time of packaging with and distribution of the associated product. As a result, the risk of mismatching the hysician/pharmacist leaflets and the patient leaflets is eliminated. Moreover, both types of leaflets can be verified by reading bar code 162 on the exposed panel 110.

It is also noted that, as shown, the patient leaflet consists of nine panels while the doctor leaflet has only three panels. The number of panels provided for each type of leaflet may be varied commensurate with the amount of indicia to be provided for that type of leaflet. For example, while sheet 163 is shown having an array of panels of three columns (i.e., C1, C2, and C3) by four rows (i.e., R1, R2, R3, and R4) more or fewer columns and/or rows may be provided. Thus, the leaflets may have different combinations of odd and even numbers of panels for each leaflet type. Additional patient leaflets may be provided as well, the additional leaflets being separable from the assembly of leaflets by tear lines. The patient leaflets may be substantially identical or different (e.g., a series of daily instructions) and may consist of different numbers of panels.

Figure 10:
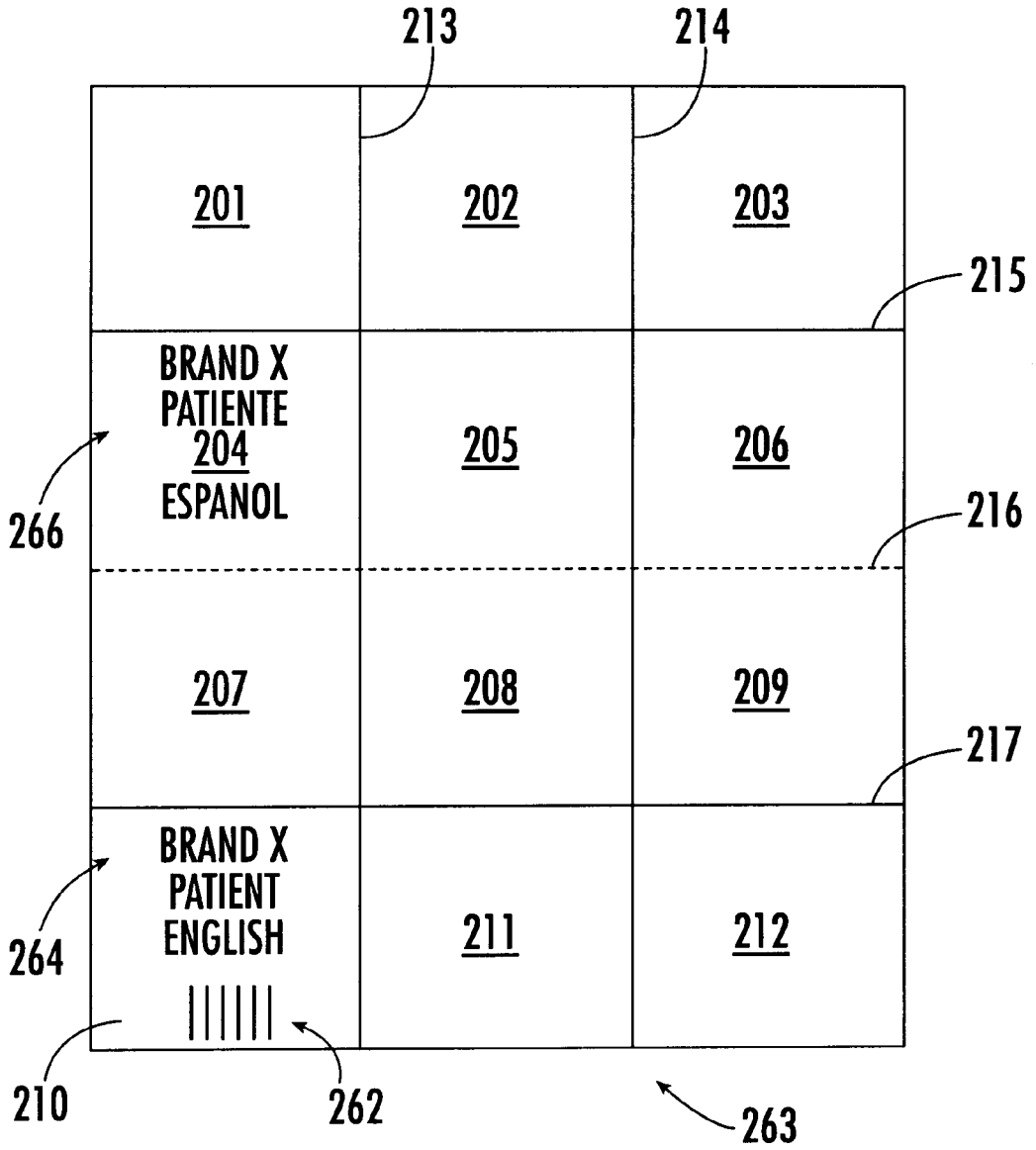
FIG. 10 is a top plan view of a sheet for forming an assembly of leaflets according to a third embodiment of the present invention.

In a further embodiment of the assembly of leaflets according to present invention, leaflets of the assembly are printed with patient information in two or more different languages. With reference to FIG. 10, the assembly of leaflets is formed from a sheet 263 having panels 201 to 212 corresponding to panels 1 to 12, respectively, of sheet 63. Panels 201 to 212 are folded about lines 213, 214, 215, 216, and 217 (which correspond to lines 13, 14, 15, 16 and 17, respectively) in the same manner as described above with respect to assembly of leaflets 60 to form an assembly of leaflets of the same construction except as follows.

Lines 215 and 217 are merely fold lines and line 26 is a tear line so that the assembly of leaflets formed from sheet 263 is separable along tear line 216 into two multi-panel leaflets consisting of panels 201 to 206 ("first patient leaflet") and panels 207 to 212 ("second patient leaflet"), respectively. The panels of the first patient leaflet have indicia printed thereon intended for the patient, the information being provided in Spanish, including indicia 266 designating the leaflet as the Spanish language patient leaflet. The second patient leaflet has indicia printed thereon representing substantially the same information except that the information is provided in English. Indicia 264 designating the second leaflet as the English language patient leaflet is printed on outer panel 210.

The assembly of leaflets just described provides the benefit that the risk of mismatching the two leaflets is eliminated because they are printed on the same sheet and are not separated prior to distribution to the end user. As a further benefit, the patient may discard the leaflet which is printed with the language with which he or she is less familiar. The leaflet retained is thereafter substantially easier to handle. It will be appreciated that the patient leaflets may be provided in languages other than English and Spanish. Moreover, additional integral leaflets may be provided (separable by additional tear lines), the additional leaflets providing the information in still further different languages.

Figure 11:
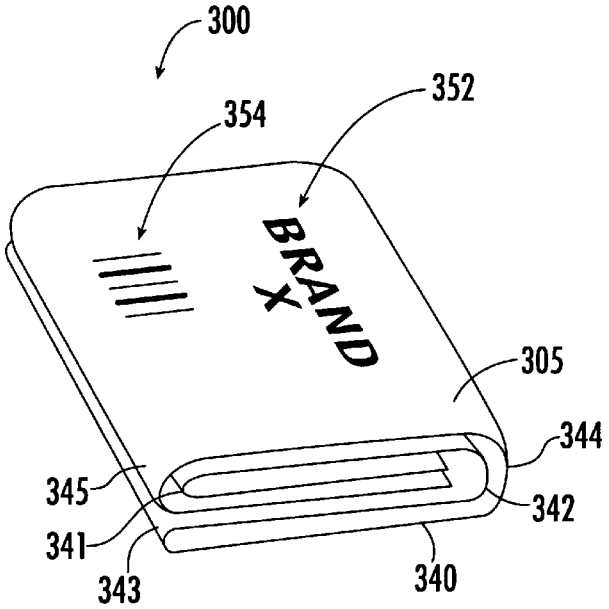
FIG. 11 is a perspective view of a convertible leaflet according to a fourth embodiment.
Figure 12:
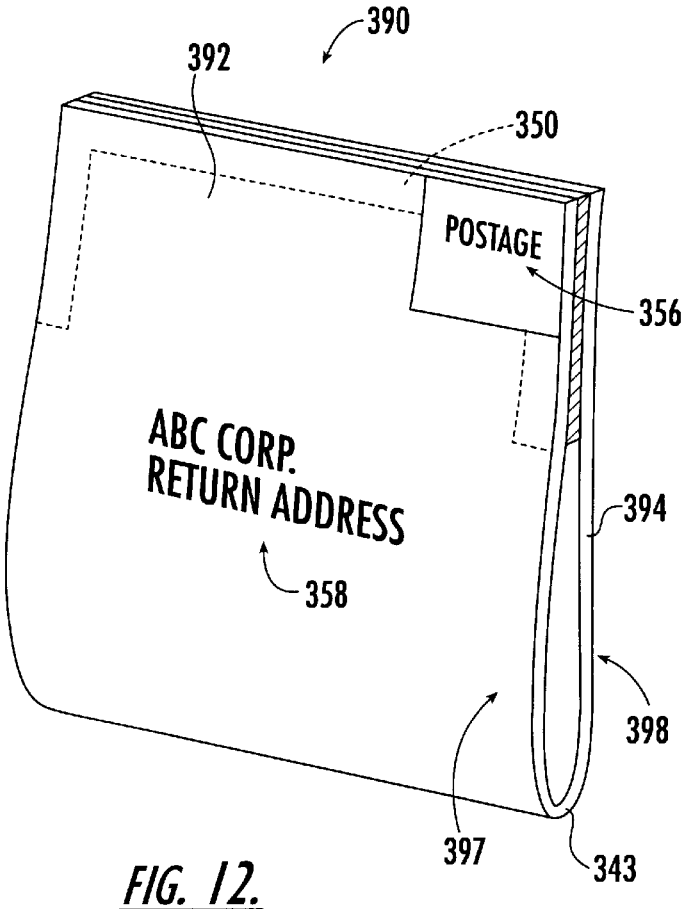
FIG. 12 is a perspective view of the leaflet of FIG. 11 converted into a return envelope.
Figure 13:
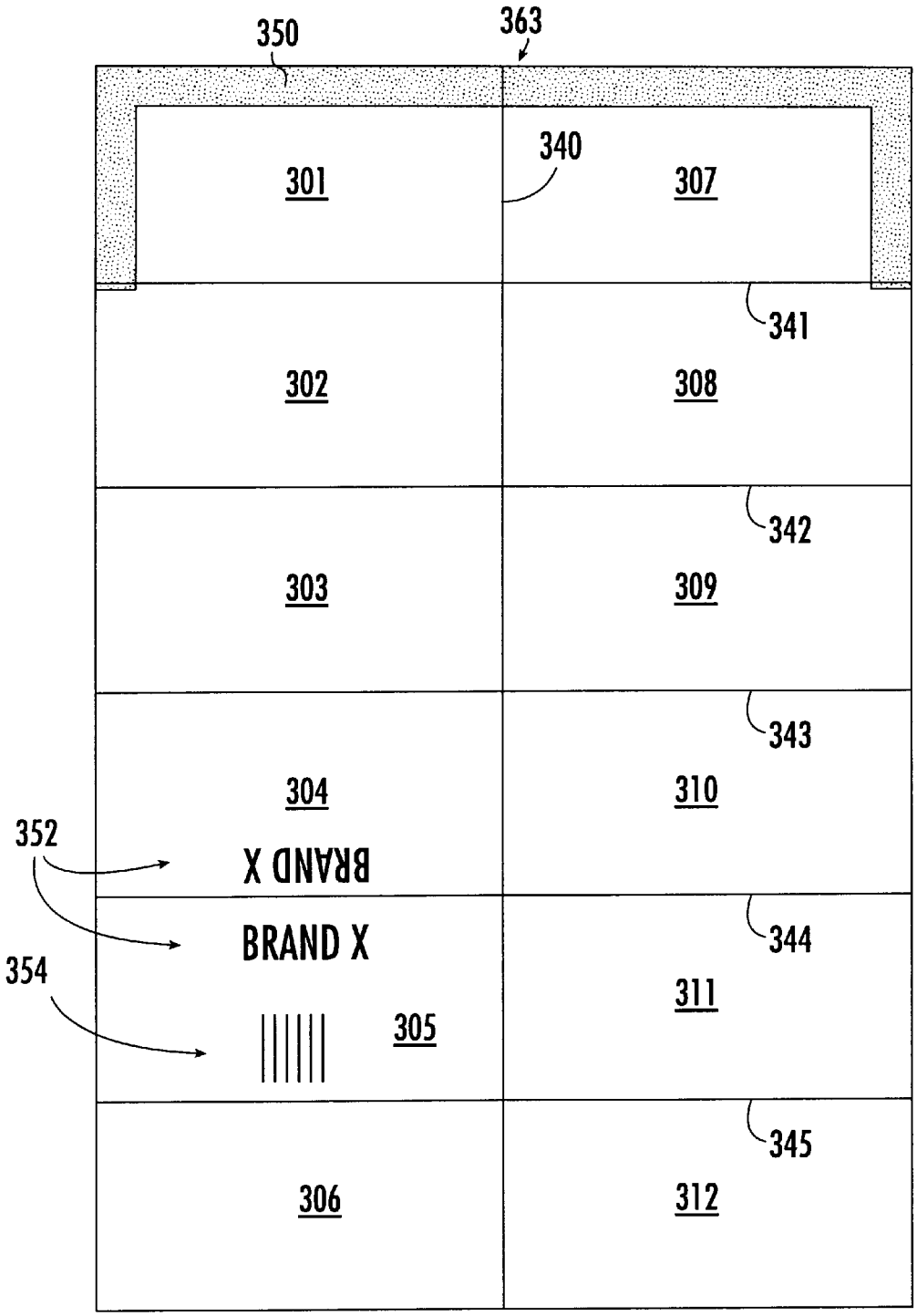
FIG. 13 is a top plan view of a sheet for forming the leaflet of FIG. 11.

With reference to FIG. 11, a leaflet 300 according to a further embodiment is shown therein. Leaflet 300 is characterized in that it may be converted from a compact leaflet as shown in FIG. 11 to an envelope 390 as shown in FIG. 12 which has a substantially larger overall area and is of a size suitable for mailing. The constructions of leaflet 300 and envelope 390 are better appreciated with reference to FIGS. 13 and 14 which show front and rear plan views, respectively, of a sheet 363 which may be used to form leaflet 300.

Sheet 363 has panels 301 to 312 defined by fold lines 340 to 345 as shown. On the front side of sheet 363, suitable title indicia 352 and bar coding 354 are printed on panels 304 and 305 which ultimately become the exterior panels of leaflet 300. The front sides of the remaining panels may be printed with any suitable indicia. For example, promotional copy, instructions and/or a questionnaire may be printed on the panels. The questionnaire may include inquiries such as questions about the product user (e.g., name, address, telephone number, email address, name of physician, name of pharmacist, user's age, user's gender, time period of using the product, history of using other medications, and favorite televisions shows or periodicals). The indicia may include questions about how the person is using the product, for example, the frequency of use. The indicia may also include questions about the user's life style and other product needs. The questionnaire may include questions about the product user's familiarity with other products from the same company or questions about the product user's satisfaction with the associated product.

A border of dry adhesive 350 is disposed on the front side of panels 301 and 307, preferably such that the adhesive extends along the top and side edges of sheet 363 as shown. It will be appreciated that the adhesive may extend further down the side edges of the front side of sheet 363. Adhesive 350 is preferably a wet activatable adhesive such as Product No. 2203 available from Fuller Adhesives of Minneapolis, Minn. In any event, adhesive 350 should be selectively activatable so that it is not exposed or so tacky that it would prevent unfolding of the leaflet prior to activation of the adhesive.

Figure 14:
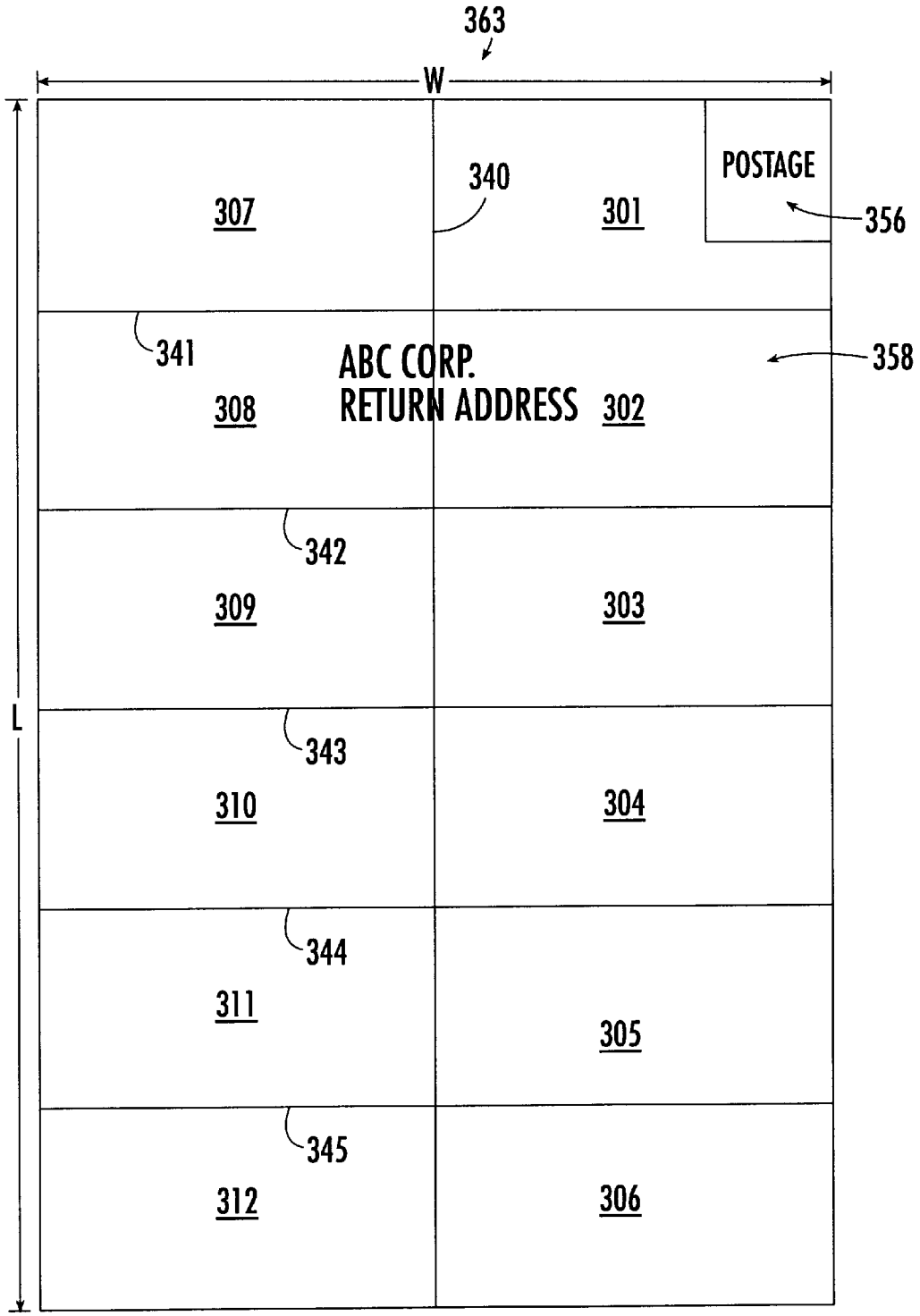
FIG. 14 is a bottom plan view of the sheet of FIG. 13.

With reference to FIG. 14, the rear side of sheet 363 is printed with suitable indicia including the address 358 to which the manufacturer desires the information to be sent by the user and preprinted postage (or indication that no postage is required), a prompt for postage or the like 356. The rear faces of any or all of the panels may be printed with indicia as well.

Leaflet 300 may be formed from sheet 363 in the following manner. From the perspective of FIG. 13, which shows a front plan view of sheet 363, panels 307 to 312 are folded beneath panels 301 to 306, respectively, about fold line 340. Panels 303, 302, and 301 are folded beneath panels 304, 305, and 306, respectively, about fold line 343. Panel 306 is folded beneath panel 305 about fold line 345. A spot or strip of adhesive (now shown) is applied to the front face of either or both of panels 303 and 306. Finally, panel 304 is folded beneath panel 305 about fold line 344 so that panels 303 and 306 are secured to one another by the glue spot or strip (not shown), thereby securing the leaflet in the folded position as shown in FIG. 11.

It will be appreciated that the multiple folds as described above results in a leaflet 300 having a relatively small size and which covers a relatively small area. The relatively compact leaflet conveniently fits in or on pharmaceutical packaging without obfuscating other indicia on the packaging or presenting a substantial impedance to handling. The end user may remove leaflet 300 from the associated product packaging in conventional fashion and unfold the leaflets to access the information printed on the interior panels. The end user, who in this case may be the pharmacist, physician and/or patient, fills out the questionnaire printed on the leaflet panels. The end user then folds the sheet about fold line 343 only. In this way envelope front panel 397 (consisting of panels 301, 302, 303, 307, 308 and 309) and envelope rear panel 398 (consisting of panels 304, 305, 306, 310, 311 and 312) are formed. The end user wets adhesive 350 and adheres together the opposed surfaces of panels 301, 307 and panels 306, 312 as shown in FIG. 12. Notably, the return address and postage are exposed once the envelope has been folded and sealed. The width W of sheet 363 (see FIG. 14) is preferably no less than 5 inches, and more preferably between about 5 and 10 inches, and the length L of sheet 363 is preferably no less than 7 inches, and more preferably, between about 7 and 10 inches. As a result, envelope 390 has dimensions of at least 3.5 by 5 inches which comply with the current U.S. Post Office requirements that a card or envelope have dimensions of at least 3.5 by 5 inches.

Figure 15:
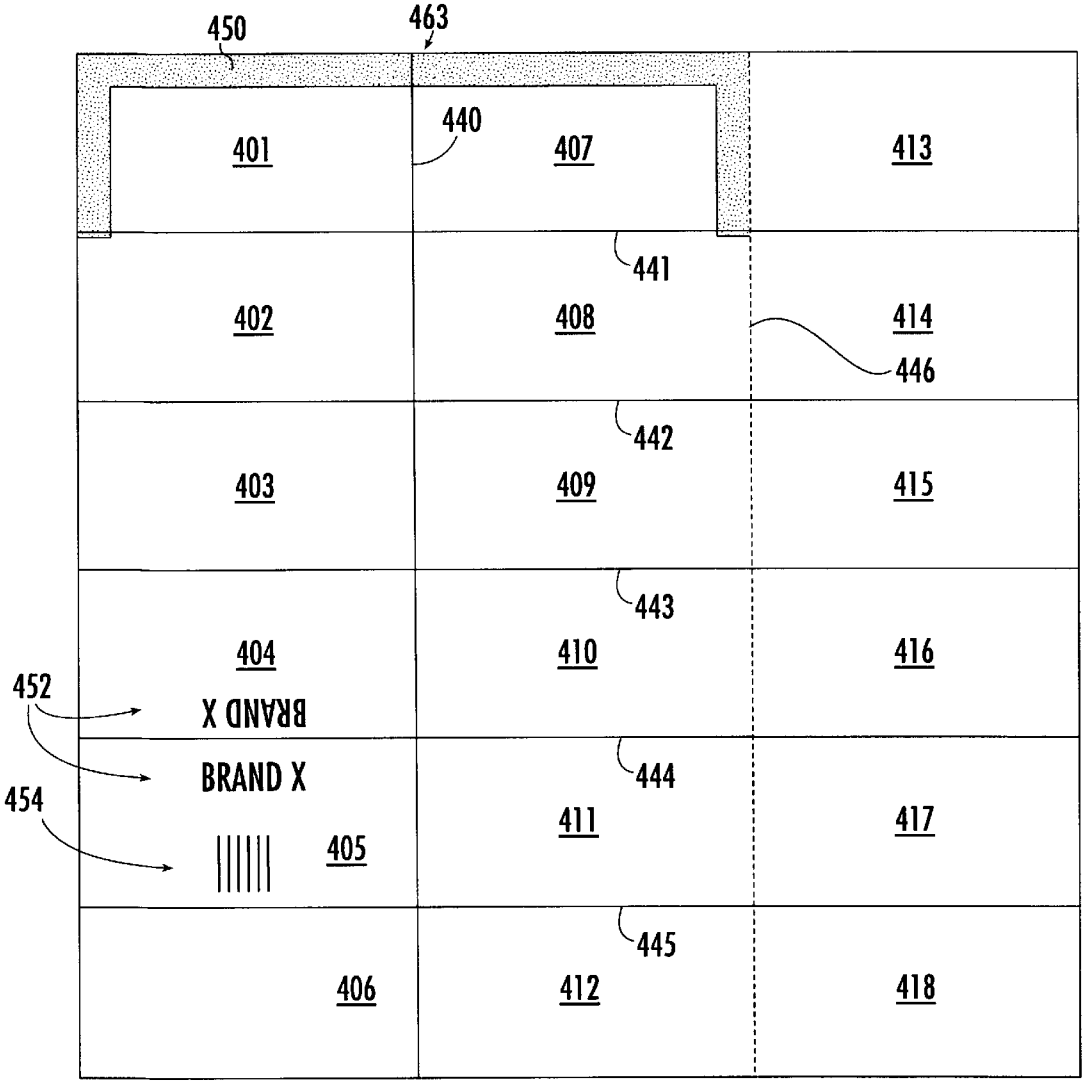
FIG. 15 is a top plan view of a sheet for forming a convertible leaflet according to a fifth embodiment of the present invention.

With reference to FIG. 15, a sheet 463 for forming a convertible leaflet (not shown) according to the present invention is shown therein. Panels 401 to 412, fold lines 440 to 445, and indicia 452, 454 correspond to panels 301 to 312, fold lines 340 to 345, and indicia 352, 354, respectively. Sheet 463 also has printed on the rear thereof address and postage indicia (not shown) corresponding to postage indicia 356 and return address indicia 358.

Sheet 463 further includes panels 413 to 418 defined by tear line 446 and fold lines 441 to 445. A continuous leaflet consisting of panels 413 to 418 can be removed from the remainder of sheet 463 by tearing along tear line 446 between panels 413 to 418 and panels 407 to 412, respectively.

The construction of the leaflet from sheet 463 differs from the formation of leaflet 300 from sheet 363 only in that panels 413 to 418 are folded under or over panels 407 to 412, respectively, prior to folding panels 407 to 412 under panels 401 to 406.

Any suitable indicia may be printed on the front and rear surfaces of panels 413 to 418. In particular, some or all of the aforedescribed questionnaire may be printed on these panels. The user may detach the strip of panels from the envelope portion of sheet 463, form an envelope from panels 401 to 412 as described above, and place panels 413 to 418 in the envelope for return to the manufacturer. Alternatively or in addition, panels 413 to 418 may include, for example, a coupon to be redeemed by the patient or the pharmacist/ physician, additional instructions concerning the product, foreign language information (e.g., information in Spanish instructing a Spanish speaking consumer to call a Spanish language telephone number for more information), information for the physician or pharmacist, or a coupon to be redeemed by the pharmacist as an inducement to motivate the pharmacist to help the product user fill out the business reply form, in which case the end user may simply remove and redeem, reference or discard the panels.

Sheet 463 and the leaflet formed therefrom may also be provided with further panels. Moreover, additional tear lines may be provided so that two or more detachable leaflet strips are formed.

Figure 16:
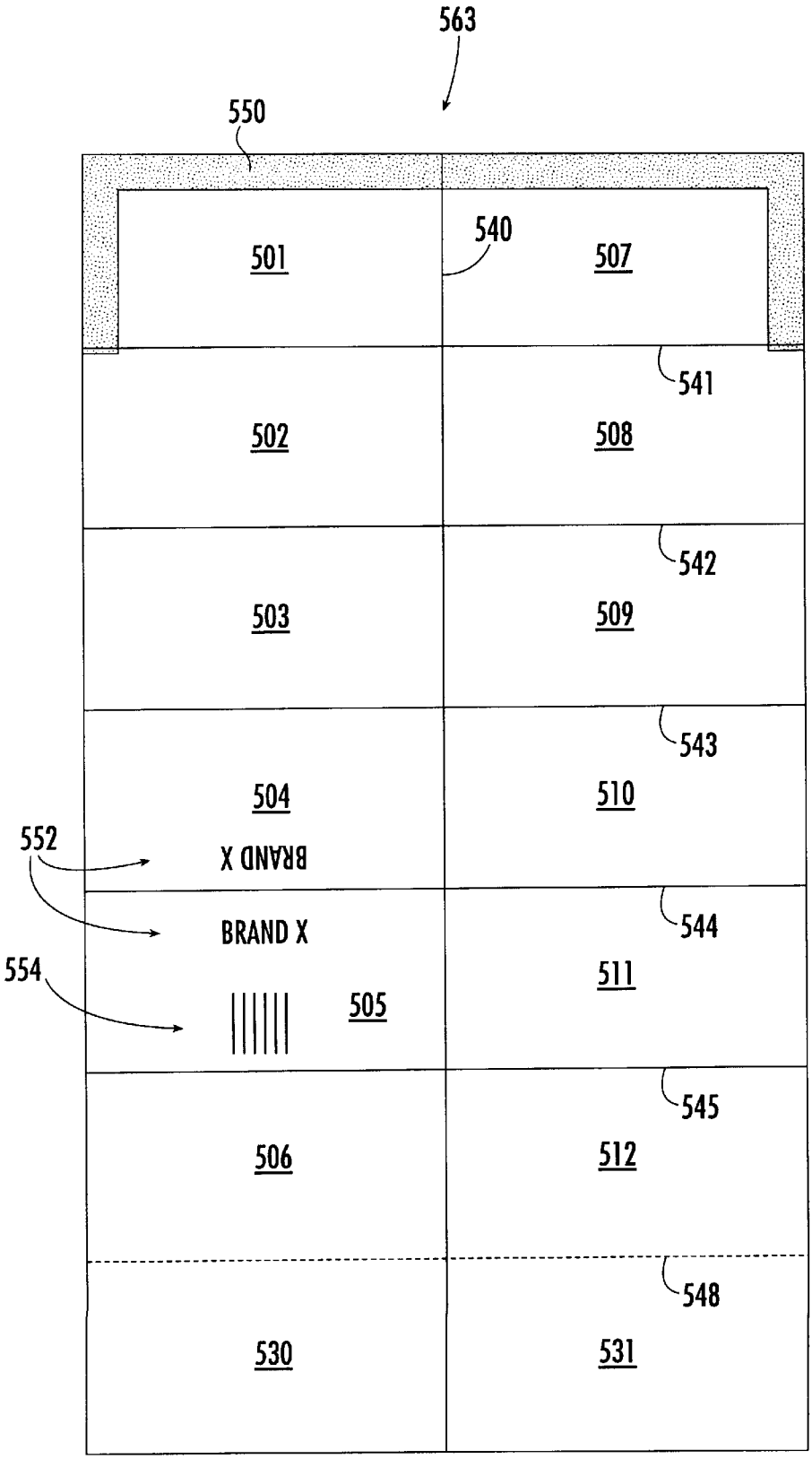
FIG. 16 is a top plan view of a sheet for forming a convertible leaflet according to a sixth embodiment of the present invention.

With reference to FIG. 16, a sheet 563 for forming a further convertible leaflet (not shown) according to the present invention is shown therein. Panels 501 to 512, fold lines 540 to 545, and indicia 552, 554 correspond to panels 301 to 312, fold lines 340 to 345, and indicia 352, 354, respectively. Sheet 563 also has printed on the rear thereof address and postage indicia (not shown) corresponding to postage indicia 356 and return address indicia 358.

Sheet 563 further includes panels 530 to 531 defined by tear line 548 and fold line 540. A unitary leaflet consisting of panels 530 and 531 can be removed from the remainder of sheet 563 by tearing along tear line 548 between panels 506, 512 and panels 530, 531, respectively.

The method for constructing a convertible leaflet from sheet 563 differs from that described for forming leaflet 300 from sheet 363 in that panel 531 is folded beneath panel 530 about fold line 540, and panel 530 is folded beneath panel 506 about tear line 548 prior to folding panel 506 beneath panel 505.

In general, the leaflet may be used in a manner substantially similar to the manner of use of the leaflet formed using sheet 463 (see FIG. 15). That is, the leaflet consisting of panels 530, 531 may be detached from the remainder of sheet 563 by tearing along tear line 548. The end user may thereafter discard panels 530, 531 or, for example, in the case of a questionnaire printed on panels 530, 531, place the detached leaflet in an envelope formed from the remainder of sheet 563. Again, more detachable panels may be provided, as well as further tear lines.

Sheet 563 may also be modified for use where it is desired for the pharmacist, physician or patient to leave panels 530, 531 attached to sheet 563 for removal by the manufacturer after the manufacturer has received the return envelope. In this case, panels 501 and 507 are lengthened so that, when sheet 563 is folded about fold line 543, a flap with adhesive 550 thereon extends beyond the upper edges of panels 506 and 512. Panels 530, 531 are folded inwardly onto panels 506, 512 about tear line 548. The aforedescribed adhesive flap is thereafter folded over the edges of panels 506, 512 (i.e., over tear line 548) and secured to the rear faces of panels 506, 512. In this way, a return envelope is formed having panels 530, 531 contained within the envelope and still attached to the envelope.

Figure 17:
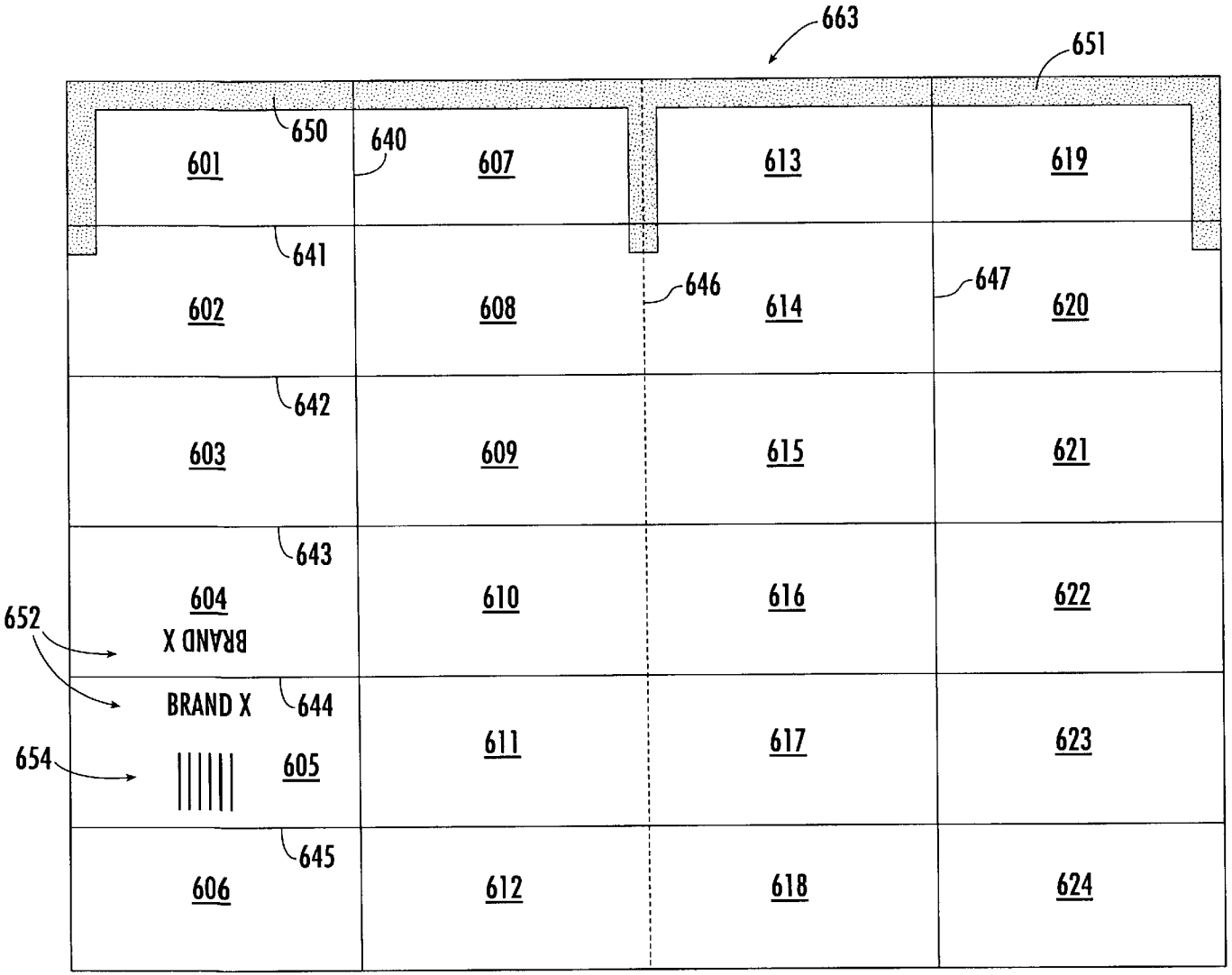
FIG. 17 is a top plan view of a sheet for forming a convertible leaflet according to a seventh embodiment of the present invention.

With reference to FIG. 17, a sheet 663 for forming a further convertible leaflet (not shown) according to the present invention is shown therein. Panels 601 to 612, fold lines 640 to 645, and indicia 652, 654 correspond to panels 301 to 312, fold lines 340 to 345, and indicia 352, 354, respectively. Sheet 663 also has printed on the rear thereof postage and address indicia (not shown) corresponding to postage indicia 356 and return address indicia 358.

Sheet 663 further includes panels 613 to 624 defined by tear line 646, fold line 647, and fold lines 641 to 645 as shown. Sheet 663 also has second adhesive border 651 disposed along the edges of at least panels 613 and 619 as shown. Postage and return address indicia corresponding to indicia 356 and 358 are also printed on the rear surface of sheet 663.

The leaflet formed using sheet 663 may be constructed by first folding panels 619 to 624 over or under panels 613 to 618, respectively, about fold line 647. Panels 613 to 618 are then folded under or over panels 607 to 612, respectively, about fold line 646. Thereafter, sheet 663 is folded in the same manner as described above with respect to sheet 363 to form leaflet 300.

In use, the end user unfolds the leaflet formed from sheet 663 to inspect the information therein and fill out the questionnaire, provided. The user then severs sheet 663 into two pieces by tearing along tear line 646. The two pieces each correspond to sheet 363 as described above and may be folded about fold line 643 to form respective return envelopes. Sheet 663 and the leaflet formed therefrom are particularly useful where it is desired to obtain information both from a pharmacist/physician and a patient. A first questionnaire for the physician may be printed on, for example, panels 601 to 612 with a second questionnaire for the patient being printed on panels 613 to 624.

Figure 18:
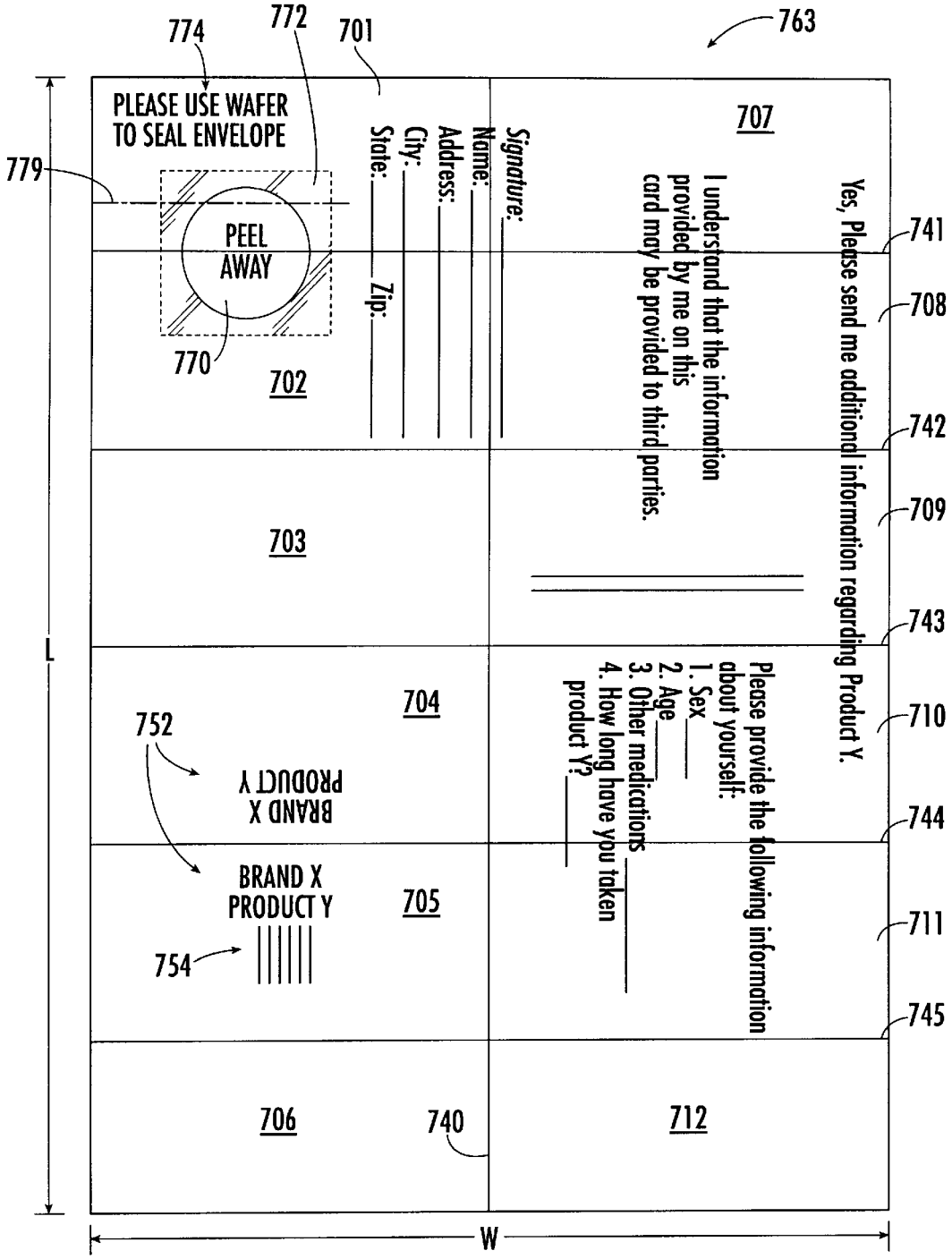
FIG. 18 is a top plan view of a sheet for forming a convertible leaflet according to a further embodiment of the present invention.
Figure 19:
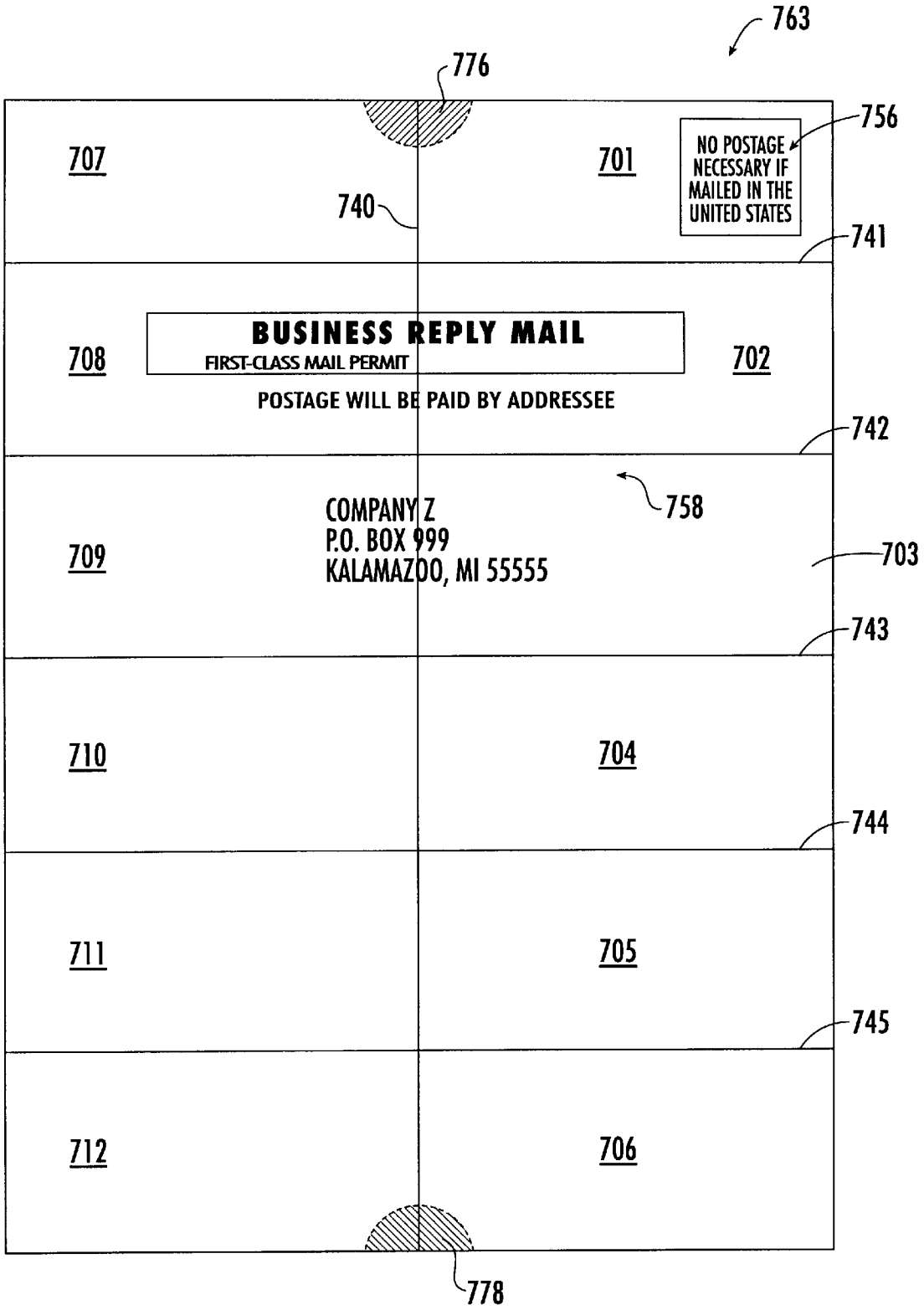
FIG. 19 is a bottom plan view of the sheet of FIG. 18.
Figure 20:
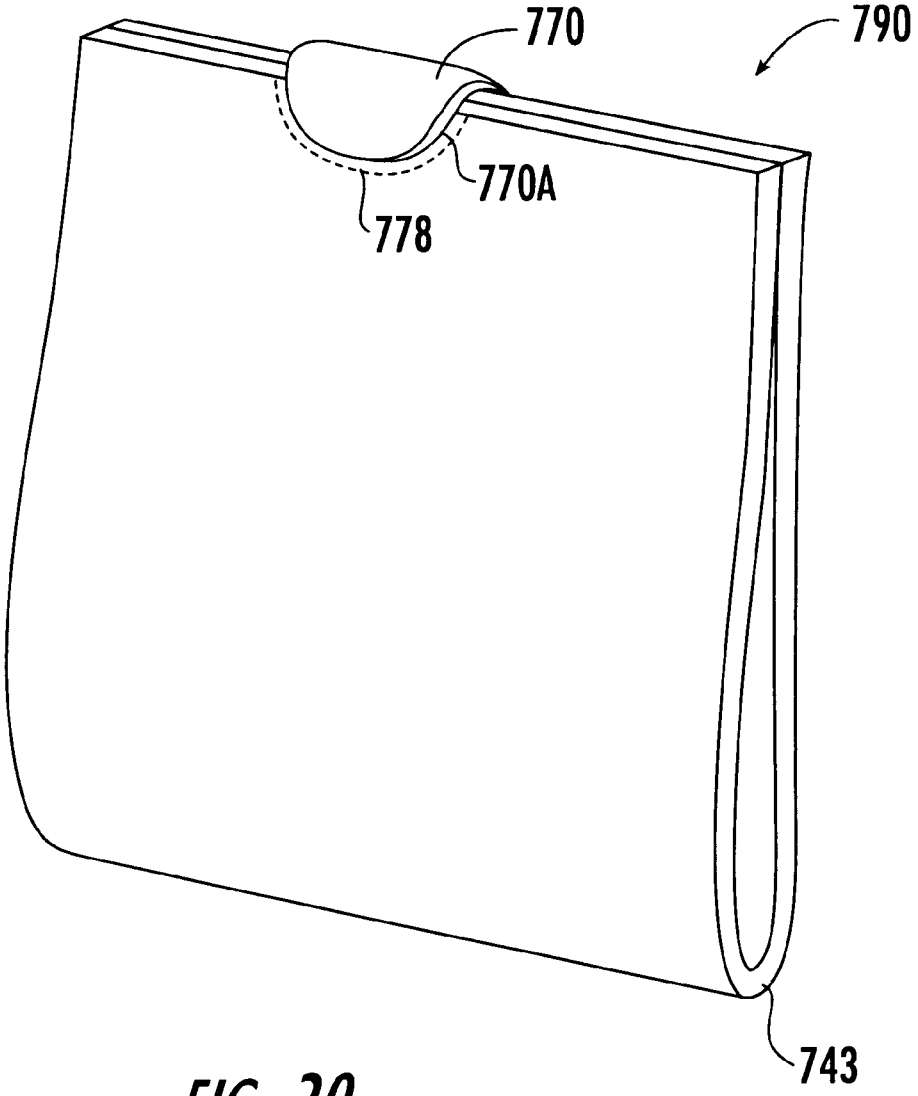
FIG. 20 is a perspective view of the sheet of FIG. 18 converted into a return envelope.

With reference to FIGS. 18 to 20, a sheet 763 for forming a convertible leaflet (not shown) according to a further embodiment of the present invention is shown therein. Sheet 763 includes elements 701 to 712, 740 to 745, 752, 754, 756 and 758 corresponding to elements 301 to 312, 340 to 345, 352, 354, 356 and 358, respectively. Sheet 763 has a length L and a width W preferably having the same dimensions as described above with respect to sheet 363. The convertible leaflet is formed by folding sheet 763 in the same manner as described above with respect to sheet 363 for forming leaflet 300 as shown in FIG. 11, with glue (not shown) securing panels 703 and 706 to one another. Similarly, the leaflet formed from sheet 763 may be unfolded and used in the same manner as leaflet 300 to form return envelope 790 as shown in FIG. 20. Notably, sheet 763 does not have adhesive corresponding to adhesive 350. Rather, sheet 763 is provided with self-adhesive wafer 770 which may be used to seal or secure sheet 763 in the closed, return envelope position as shown in FIG. 20.

Suitable indicia 774 printed on sheet 763 and/or wafer 770 is provided to instruct the user as to how to use the self-adhesive wafer to seal the return envelope. Typically, indicia 774 will include instructions to remove the wafer from the sheet and to reapply the wafer to the envelope to seal the envelope. The instructions may specifically direct the user to apply the wafer over the opposed edges of the sheet such that portions of the wafer engage both of the areas 776 and 778, whether varnish is provided in those areas or not. Indicia may also be provided instructing the user as to how to form the envelope.

Turning to the sealing system of sheet 763 in greater detail, a layer of varnish 772 is provided on the inner surface of sheet 763. Varnish 772 is preferably a coating printed directly onto sheet 763. Further, varnish 772 is preferably clear so that it does not obstruct view of indicia printed thereunder on sheet 763. Suitable varnishes include OP Varnish T6 available from Superior Inc. of New York. Alternatively, the varnish may be provided on a self-adhesive release liner stock.

Self-adhesive wafer 770 may be formed of a paper or polymeric stock having a backing layer of pressure sensitive adhesive 770A. Self-adhesive wafer 770 is releasably secured to varnish 772 by adhesive 770A. The wafer stock, adhesive 770A, and varnish 772 are chosen such that, when wafer 770 is peeled away from varnish 772, adhesive 770A remains on the undersurface of wafer 770 and, furthermore, remains activated. Preferably, wafer 770 has a diameter of about one inch. Optionally, score line 779 may be formed through wafer 770 and into sheet 763 to facilitate removal of wafer 770 from the sheet. Preferably, self-adhesive wafer 770 is transparent so that indicia thereunder remains visible. While wafer 770 is shown as circular, it will be appreciated that other shapes and sizes may be employed.

Optionally, further varnish coatings 776 and 778 may be printed on the outer surface of sheet 763 along the opposed edges thereof. These varnish coatings are intended to receive the self-adhesive wafer for sealing return envelope 790. Suitable indicia (not shown) may be printed beneath or adjacent varnish coatings 776, 778 to direct the user to apply the wafer over these regions. When the manufacturer or the like receives return envelope 790, it may open the return envelope and access the information therein by simply peeling the wafer away from one of the varnish coated regions 776, 778, thereby minimizing damage to sheet 763.

While the sealing system including self-adhesive wafer 770 and varnish coating 772, as well as the optional enhancements, are shown in combination with a sheet 763 for forming a leaflet and return envelope 790 similar to the leaflet and envelope of sheet 363, it will be readily appreciated that these features may be substituted for the adhesive layers described above with regard to sheets 363, 463, 563, 663, and the variations thereof. Moreover, the wafer sealing system may be used with an unfolded sheet or card. If the sheet is designed to provide more than one return envelope, for example, as in the case of sheet 663 (see FIG. 17), then a plurality of removable, self-adhesive wafers corresponding to wafer 770 would be provided, preferably with wafers being provided on each of the separable portions of the sheet. More than one wafer 770 may be provided for each envelope. For example, three (3) wafers may be provided, one for each free edge of the envelope.

Sheet 763 and the leaflet formed therefrom may be manufactured in the same manner as described above with regard to sheet 363 and leaflet 300, except as follows. Instead of printing an envelope adhesive corresponding to adhesive 350, varnish coatings 772, 776, and 778 are printed on the appropriate areas of sheet 763, preferably prior to cutting the sheet from a web. After sheet 763 is printed and cut, pressure sensitive wafer 770 is applied to varnish coating 772. The self-adhesive wafers may be carried on a pressure sensitive release liner and applied by means of a suitable label applicator. Preferably, self-adhesive wafer 770 is blown onto sheet 763. Alternatively, wafer 770 may be applied in any conventional manner known in the art for applying pressure sensitive labels. Thereafter, sheet 763 is folded as described above.

The convertible leaflets described above having return envelope portions are particularly beneficial in facilitating one-to-one relationship marketing. The leaflets having detachable portions are particularly useful in that they allow the manufacturer to offer of a detachable coupon for the physician or the patient. Because the patient's questionnaire responses are contained within the envelope, the patient is less likely to hesitate to fill out and return the questionnaire and therefore is more likely to provide to the manufacturer with personal and useful information about the specific consumer or class of consumers. The manufacturer may use the information to modify its targeted marketing to directly communicate with consumers of its products, or to identify heavy users of its products. Notably, the leaflets as described above overcome a traditional problem that the manufacturers usual source of information, namely, the physician or pharmacist, it often prohibited by regulations from giving certain personal information about their patients. Rather, the patients provide the information to the manufacturer directly.

It will be appreciated by those of skill in the art upon a reading of the foregoing description of the preferred embodiments that the leaflets may be provided with different configurations and numbers of panels, fold lines, and tear lines.

Certain improvements and modifications will be readily apparent to those skilled in the art upon a reading of the foregoing description of the preferred embodiment. For example, the individual title panels may be numbered to aid the user in keeping track of the number of leaflets, and thus, sub-packages, dispensed. All such improvements and modifications are intended to come within the scope of the claims which follow. The term "comprising" as used in the claims which follow specifies the presence of the stated features, integers, steps or components as referred to in the claims, but does not preclude the presence or addition of one or more other features, integers, steps, components or groups thereof.

What is claimed:

1. A method for forming a literature assembly, comprising the steps of:

a. imprinting a first identifier on a first leaflet;

b. imprinting a second identifier on an assembly of leaflets;

c. releasably securing the assembly of leaflets to the first leaflet, the assembly of leaflets including a plurality of integral and detachable second leaflets.

2. The method of claim 1 wherein the steps of imprinting the first and second identifiers include imprinting electronically readable identifiers corresponding to information imprinted on each of said first and second leaflets, respectively.

3. The method of claim 1 further including the step of forming the assembly of leaflets prior to the step of adhering, said step of forming the assembly of leaflets comprising the steps of:

a. folding a single sheet about a first fold line;

b. folding the sheet about a second fold line transverse to the first fold line, thereby forming a pair of leaflets defined on either side of the second fold line; and c. forming a tear line along the second fold line.

4. A method for forming an assembly of leaflets, comprising the steps of:

a. folding a single sheet about a first fold line;

b. folding the sheet about a second fold line transverse to the first fold line, thereby forming a pair of leaflets defined on either side of the second fold line; and c. forming a tear line along the second fold line.

5. An assembly of leaflets, comprising:

a. a single sheet;

b. wherein said sheet is folded about a first fold line and about a second fold line transverse to said first fold line, whereby said sheet is divided into at least four panels, said second fold line defining a pair of leaflets, one of said leaflets disposed on either side of said second fold line;

c. a tear line provided at said second fold line whereby respective leaflets may be detached from one another; and d. wherein each of said leaflets has substantially different, related indicia imprinted thereon.

6. The assembly of leaflets of claim 5 wherein one of said pair of leaflets comprises a greater number of panels than the other of said pair of leaflets.

7. The assembly of leaflets of claim 5 wherein one of said pair of leaflets has indicia imprinted thereon representing information directed to at least one of a physician and a pharmacist and the other of said pair of leaflets has indicia imprinted thereon directed to a patient.

8. The assembly of leaflets of claim 5 wherein one of said pair of leaflets has indicia imprinted thereon representing information directed to a patient and in a first language and the other of said pair of leaflets has indicia imprinted thereon representing information directed to the patient and in a second, different language.

9. A literature assembly, comprising:

a. a first leaflet including a first identifier; and b. an assembly of leaflets secured to said first leaflet and including a second identifier, said assembly of leaflets including:

(1) a single sheet;

(2) wherein said sheet is folded about a first fold line and about second fold line transverse to said first fold line, whereby said sheet is divided into at least four panels, said second fold line defining a pair of second leaflets, one of said second leaflets disposed on either side of said second fold line;

(3) a tear line provided at said second fold line whereby respective said second leaflets may be detached from one another; and (4) wherein each of said second leaflets has substantially different, related indicia imprinted thereon.

10. The literature assembly of claim 9 wherein one of said pair of second leaflets comprises a greater number of panels than the other of said pair of second leaflets.

11. The literature assembly of claim 9 wherein one of said pair of second leaflets has indicia imprinted thereon representing information directed to at least one of a physician and a pharmacist and the other of said pair of second leaflets has indicia imprinted thereon directed to a patient.

12. The literature assembly of claim 9 wherein one of said pair of second leaflets has indicia imprinted thereon representing information directed to a patient and in a first language and the other of said pair of second leaflets has indicia imprinted thereon representing information directed to the patient and in a second, different language.

13. An assembly of leaflets, comprising:

a. a single sheet;

b. wherein said sheet is folded about a first fold line and about a second fold line transverse to said first fold line, whereby said sheet is divided into at least four panels, said second fold line defining a pair of leaflets, one of said leaflets disposed on either side of said second fold line;

c. a tear line provided at said second fold line whereby respective leaflets may be detached from one another; and d. wherein at least one of said leaflets is formable into an envelope sized and configured to receive another of said leaflets.

14. The assembly of leaflets of claim 13 including a wafer having a coating of adhesive on a rear surface thereof, said wafer releasably adhered to said sheet by said adhesive such that, upon removal of said wafer from said sheet, said adhesive remains on said rear surface and is operable to readhere said wafer to said sheet for sealing said envelope.

15. A literature assembly, comprising:

a. a first leaflet including a first identifier; and b. an assembly of leaflets secured to said first leaflet and including a second identifier, said assembly of leaflets including:

(1) a single sheet;

(2) wherein said sheet is folded about a first fold line and about a second fold line transverse to said first fold line, whereby said sheet is divided into at least four panels, said second fold line defining a pair of second leaflets, one of said second leaflets disposed on either side of said second fold line;

(3) a tear line provided at said second fold line whereby respective said second leaflets may be detached from one another; and (4) wherein at least one of said second leaflets is formable into an envelope sized and configured to receive another of said second leaflets.

16. The literature assembly of claim 15 including a wafer having a coating of adhesive on a rear surface thereof, said wafer releasably adhered to said sheet by said adhesive such that, upon removal of said wafer from said sheet, said adhesive remains on said rear surface and is operable to readhere said wafer to said sheet for sealing said envelope.

17. A convertible, folded leaflet, comprising:

a. a single sheet folded about a first fold line whereby said sheet is divided into first and second panels, said sheet further folded about a second fold line transverse to said first fold line and whereby each of said first and second panels is divided into at least two subpanels;

b. a selectively activatable adhesive strip disposed on at least one of said first and second panels;

c. address indicia representing a mailing address printed on at least one of said first and second panels; and d. a tear line transverse to said first fold line and spaced apart from said second fold line, said sheet folded about said tear line whereby said first and second panels are divided into at least two additional subpanels;

e. wherein said sheet may be unfolded about said second fold line and, when said sheet is unfolded about said second fold line, said first and second panels form an envelope selectively sealable by means of said adhesive strip and said address indicia is exposed;

f. wherein said additional subpanels are detachable from said leaflet by tearing along said tear line, a remainder of said leaflet being formable into said envelope.

18. The convertible folded leaflet of claim 17 including questionnaire indicia representing questions and including areas for inserting responses thereto, said questionnaire indicia printed on at least one of said first and second panels on a side thereof opposite said address indicia whereby, when said first and second panels form said envelope, at least a portion of said questionnaire indicia is disposed within said envelope.

19. The convertible, folded leaflet of claim 17 wherein said envelope has a width of at least 3.5 inches and a length of at least 5 inches.

20. A convertible, folded leaflet, comprising:

a. a single sheet folded about a first fold line whereby said sheet is divided into first and second panels, said sheet further folded about a second fold line transverse to said first fold line and whereby each of said first and second panels is divided into at least two subpanels;

b. a selectively activatable adhesive strip disposed on at least one of said first and second panels;

c. address indicia representing a mailing address printed on at least one of said first and second panels; and d. a tear line transverse to said second fold line and spaced apart from said first fold line, said sheet folded about said tear line to define a third panel adjoining said second panel;

e. wherein said sheet may be unfolded about said second fold line and, when said sheet is unfolded about said second fold line, said first and second panels form an envelope selectively sealable by means of said adhesive strip and said address indicia is exposed;

f. wherein said third panel is detachable from said leaflet by tearing along said tear line, a remainder of said leaflet being formable into said envelope.

21. The convertible folded leaflet of claim 20 including questionnaire indicia representing questions and including areas for inserting responses thereto, said questionnaire indicia printed on at least one of said first and second panels on a side thereof opposite said address indicia whereby, when said first and second panels form said envelope, at least a portion of said questionnaire indicia is disposed within said envelope.

22. The convertible, folded leaflet of claim 20 wherein said envelope has a width of at least 3.5 inches and a length of at least 5 inches.

23. A convertible, folded leaflet, comprising:

a. a single sheet folded about a first fold line whereby said sheet is divided into first and second panels, said sheet further folded about a second fold line transverse to said first fold line and whereby each of said first and second panels is divided into at least two subpanels; and b. a tear line transverse to one of said first and second fold lines, said sheet being folded about said tear line to define first and second envelope portions on either side of said tear line;

c. each of said first and second envelope portions having a respective selectively activatable adhesive strip disposed thereon and address indicia disposed thereon and being foldable about a respective envelope fold whereby each of said first and second envelope portions may be converted to a selectively sealable envelope.

24. The convertible folded leaflet of claim 23 wherein at least one of said envelope portions includes questionnaire indicia representing questions and including areas for inserting responses thereto, said questionnaire indicia printed opposite said address indicia whereby, when said at least one of said envelopes is formed, at least a portion of said questionnaire indicia is disposed within said at least one of said envelopes.

25. The convertible, folded leaflet of claim 23 wherein each of said envelopes has a width of at least 3.5 inches and a length of at least 5 inches.

26. A literature assembly, comprising:

a. a first leaflet including a first identifier; and b. a convertible, folded leaflet secured to said first leaflet and including a second identifier, said convertible, folded leaflet including:

(1) a single sheet folded about a first fold line whereby said sheet is divided into first and second panels, said sheet further folded about a second fold line transverse to said first fold line and whereby each of said first and second panels is divided into at least two subpanels;

(2) a selectively activatable adhesive strip disposed on at least one of said first and second panels;

(3) address indicia representing a mailing address printed on at least one of said first and second panels; and (4) a tear line transverse to said first fold line and spaced apart from said second fold line, said sheet folded about said tear line whereby said first and second panels are divided into at least two additional subpanels;

(5) wherein said sheet may be unfolded about said second fold line and, when said sheet is unfolded about said second fold line, said first and second panels form an envelope selectively sealable by means of said adhesive strip and said address indicia is exposed;

(6) wherein said additional subpanels are detachable from said leaflet by tearing along said tear line, a remainder of said leaflet being formable into said envelope.

27. The literature assembly of claim 26 including questionnaire indicia representing questions and including areas for inserting responses thereto, said questionnaire indicia printed on at least one of said first and second panels on a side thereof opposite said address indicia whereby, when said first and second panels form said envelope, at least a portion of said questionnaire indicia is disposed within said envelope.

28. The literature assembly of claim 26 wherein said envelope has a width of at least 3.5 inches and a length of at least 5 inches.

29. A literature assembly, comprising:

a. a first leaflet including a first identifier; and b. a convertible, folded leaflet secured to said first leaflet and including a second identifier, said convertible, folded leaflet including:

(1) a single sheet folded about a first fold line whereby said sheet is divided into first and second panels, said sheet further folded about a second fold line transverse to said first fold line and whereby each of said first and second panels is divided into at least two subpanels;

(2) a selectively activatable adhesive strip disposed on at least one of said first and second panels;

(3) address indicia representing a mailing address printed on at least one of said first and second panels; and (4) a tear line transverse to said second fold line and spaced apart from said first fold line, said sheet folded about said tear line to define a third panel adjoining said second panel;

(5) wherein said sheet may be unfolded about said second fold line and, when said sheet is unfolded about said second fold line, said first and second panels form an envelope selectively sealable by means of said adhesive strip and said address indicia is exposed;

(6) wherein said third panel is detachable from said leaflet by tearing along said tear line, a remainder of said leaflet being formable into said envelope.

30. The convertible folded leaflet of claim 29 including questionnaire indicia representing questions and including areas for inserting responses thereto, said questionnaire indicia printed on at least one of said first and second panels on a side thereof opposite said address indicia whereby, when said first and second panels form said envelope, at least a portion of said questionnaire indicia is disposed within said envelope.

31. The convertible, folded leaflet of claim 29 wherein said envelope has a width of at least 3.5 inches and a length of at least 5 inches.

32. A literature assembly, comprising:

a. a first leaflet including a first identifier; and b. a convertible, folded leaflet secured to said first leaflet and including a second identifier, said convertible, folded leaflet including:

(1) a single sheet folded about a first fold line whereby said sheet is divided into first and second panels, said sheet further folded about a second fold line transverse to said first fold line and whereby each of said first and second panels is divided into at least two subpanels; and (2) a tear line transverse to one of said first and second fold lines, said sheet being folded about said tear line to define first and second envelope portions on either side of said tear line;

(3) each of said first and second envelope portions having a respective selectively activatable adhesive strip disposed thereon and address indicia disposed thereon and being foldable about a respective envelope fold whereby each of said first and second envelope portions may be converted to a selectively sealable envelope.

33. The convertible folded leaflet of claim 32 wherein at least one of said envelope portions includes questionnaire indicia representing questions and including areas for inserting responses thereto, said questionnaire indicia printed opposite said address indicia whereby, when said at least one of said envelopes is formed, at least a portion of said questionnaire indicia is disposed within said at least one of said envelopes.

34. The convertible, folded leaflet of claim 32 wherein each of said envelopes has a width of at least 3.5 inches and a length of at least 5 inches.

35. A printed article convertible by a user into an envelope, said convertible article comprising:

a. a sheet foldable to form an envelope;

b. a wafer having a coating of adhesive on a rear surface thereof, said wafer releasably adhered to said sheet by said adhesive such that, upon removal of said wafer from said sheet, said adhesive remains on said rear surface and is operable to readhere said wafer to said sheet; and c. instruction indicia disposed on at least one of said sheet and said wafer, said instruction indicia directing the user to use said wafer to secure said envelope in a closed position.

36. The convertible article of claim 35 including a varnish coating directly disposed on said sheet and between said sheet and said adhesive, said wafer being releasably adhered to said varnish coating.

37. The convertible article of claim 36 including indicia disposed on said sheet and underlying said varnish coating, and wherein said varnish coating is transparent whereby said indicia is visible through said varnish coating.

38. The convertible article of claim 35 including a second varnish coating on said sheet, said second varnish coating positioned to receive said wafer when said wafer is reapplied to said sheet to secure said envelope, whereby said wafer is releasably adhered to said sheet.

39. The convertible article of claim 35 including a score line formed through said wafer to facilitate removal by the user at least a portion of said wafer from said sheet.

40. The convertible article of claim 35 wherein said sheet is folded about a first fold line whereby said sheet is divided into first and second panels, said sheet further folded about a second fold line transverse to said first fold line and whereby each of said first and second panels is divided into at least two subpanels.

41. The convertible article of claim 35 including address indicia representing a mailing address printed on said sheet.

42. The convertible article of claim 35 wherein said envelope has a width of at least 3.5 inches and a length of at least 5 inches.

43. The convertible article of claim 35 including a tear line formed in said sheet whereby said sheet can be separated into first and second portions, said first portion being formable into said envelope.

44. A convertible, folded leaflet, comprising:

a. a single sheet folded about a first fold line whereby said sheet is divided into first and second panels, said sheet further folded about a second fold line transverse to said first fold line and whereby each of said first and second panels are divided into at least two subpanels;

b a wafer having a coating of adhesive on a rear surface thereof, said wafer releasably adhered to said sheet by said adhesive such that, upon removal of said wafer from said sheet, said adhesive remains on said rear surface and is operable to readhere said wafer to said sheet; and c. address indicia representing a mailing address printed on at least one of said first and second panels; and d. wherein said sheet may be unfolded about said second fold line and, when said sheet is unfolded about said second fold line, said first and second panels form an envelope selectively sealable by means of said wafer and said address indicia is exposed.

45. The convertible, folded leaflet of claim 44 including instruction indicia disposed on at least one of said sheet and said wafer, said instruction indicia directing the user to use said wafer to secure said envelope in a closed position.

46. The convertible, folded leaflet of claim 44 including questionnaire indicia representing questions and including areas for inserting responses thereto, said questionnaire indicia printed on at least one of said first and second panels on a side thereof opposite said address indicia whereby, when said first and second panels form said envelope, at least a portion of said questionnaire indicia is disposed within said envelope.

47. The convertible, folded leaflet of claim 44 wherein said envelope has a width of at least 3.5 inches and a length of at least 5 inches.

48. The convertible, folded leaflet of claim 44 including a tear line transverse to said first fold line and spaced apart from said second fold line, said sheet folded about said tear line whereby said first and second panels are divided into at least two additional subpanels, and wherein said additional subpanels are detachable from said leaflet by tearing along said tear line, a remainder of said leaflet being formable into said envelope.

49. The convertible, folded leaflet of claim 44 including a tear line transverse to said second fold line and spaced apart from said first fold line, said sheet folded about said tear line to define a third panel adjoining said second panel, and wherein said third panel is detachable from said leaflet by tearing along said tear line, a remainder of said leaflet being formable into said envelope.

50. The convertible, folded leaflet of claim 44 further including a tear line transverse to one of said first and second fold lines, said sheet being folded about said tear line to define first and second envelope portions on either side of said tear line, each of said first and second envelope portions having a respective self-adhesive wafer disposed thereon and being foldable about a respective envelope fold whereby each of said first and second envelope portions may be converted to a selectively sealable envelope.

51. The convertible, folded leaflet of claim 50 wherein each of said envelopes has a width of at least 3.5 inches and a length of at least 5 inches.

52. A method of converting an informational sheet into a return envelope, said method comprising the steps of:

providing an article comprising:

a. a sheet foldable to form an envelope; and b. a wafer having a coating of adhesive on a rear surface thereof, the wafer releasably adhered to the sheet by the adhesive such that, upon removal of the wafer from the sheet, the adhesive remains on the rear surface and is operable to readhere the wafer to the sheet;

removing the wafer from the sheet;

folding the sheet to form the envelope; and reapplying the wafer to the folded sheet such that the wafer is adhered thereto and thereby maintains the envelope in a closed position.

53. The method of claim 52 including the step of unfolding the sheet prior to said steps of removing the wafer, folding the sheet and reapplying the wafer.

54. The method of claim 52 including, prior to said steps of folding the sheet and reapplying the wafer, the step of writing information onto a surface of the sheet which is not readily visible from the outside of the envelope.

* * * * *